US010994538B2

(12) United States Patent
Takino

(10) Patent No.: US 10,994,538 B2
(45) Date of Patent: May 4, 2021

(54) LIQUID EJECTING HEAD AND LIQUID EJECTING APPARATUS

(71) Applicant: SEIKO EPSON CORPORATION, Tokyo (JP)

(72) Inventor: Fumiya Takino, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/791,040

(22) Filed: Feb. 14, 2020

(65) Prior Publication Data

US 2020/0262198 A1 Aug. 20, 2020

(30) Foreign Application Priority Data

Feb. 15, 2019 (JP) ..... JP2019-025243

(51) Int. Cl.
*B41J 2/14* (2006.01)
*B41J 2/135* (2006.01)
*B41J 2/175* (2006.01)

(52) U.S. Cl.
CPC ..... *B41J 2/135* (2013.01); *B41J 2/175* (2013.01); *B41J 2002/14491* (2013.01)

(58) Field of Classification Search
None
See application file for complete search history.

(56) References Cited

U.S. PATENT DOCUMENTS

2015/0202866 A1 7/2015 Akahane
2016/0009087 A1* 1/2016 Okui ..... B41J 2/17526 347/50
2016/0031214 A1* 2/2016 Okui ..... B41J 2/14 347/50
2019/0009592 A1* 1/2019 Okushima ..... B41J 29/377

FOREIGN PATENT DOCUMENTS

JP 2015-136866 7/2015
JP 2016-020031 2/2016
JP 2016-034739 3/2016

* cited by examiner

*Primary Examiner* — Erica S Lin
*Assistant Examiner* — Tracey M McMillion
(74) *Attorney, Agent, or Firm* — Workman Nydegger

(57) ABSTRACT

A liquid ejecting head has head units for ejecting a liquid from nozzles onto a medium that is relatively moved in a first direction are arranged in a second direction perpendicular to the first direction. The head unit includes: a nozzle row in which the nozzles are arranged in a third direction intersecting the first direction and the second direction; a pressure chamber which communicates with the nozzles; a pressure generation element which corresponds to the pressure chamber; a supply liquid chamber which communicates with the pressure chambers and into which the liquid to be supplied to each pressure chamber is introduced; an inflow port through which the liquid flows into the head unit; and an outflow port through which the liquid flows out of the head unit.

4 Claims, 21 Drawing Sheets

LIQUID EJECTING HEAD AND LIQUID EJECTING APPARATUS

The present application is based on, and claims priority from JP Application Serial Number 2019-025243, filed Feb. 15, 2019, the disclosure of which is hereby incorporated by reference herein in its entirety.

BACKGROUND

1. Technical Field

The present disclosure relates to a liquid ejecting head such as an ink jet recording head, and a liquid ejecting apparatus including the same, and more particularly, to a liquid ejecting head through which a liquid circulates between the liquid ejecting head and a liquid storage member, and a liquid ejecting apparatus.

2. Related Art

A liquid ejecting apparatus is an apparatus which includes a liquid ejecting head and ejects (emits) various liquids as droplets from the liquid ejecting head. Examples of the liquid ejecting apparatus include an image recording apparatus such as an ink jet printer and an ink jet plotter. In recent years, the liquid ejecting apparatus has been applied to various manufacturing apparatuses, due to characteristics thereof that a very small amount of the liquid can be accurately landed at a predetermined position. For example, the liquid ejecting apparatus is applied to a display manufacturing apparatus for manufacturing a color filter such as a liquid crystal display, an electrode forming apparatus for forming an electrode of an organic electro-luminescence (EL) display, a surface light emission display (FED), or the like, and a chip manufacturing apparatus for manufacturing a biochip (biochemical element). A recording head for the image recording apparatus ejects a liquid containing a color material, and a color material ejecting head for the display manufacturing apparatus ejects a liquid containing color materials such as red, green, and blue. Further, an electrode material ejecting head for the electrode forming apparatus ejects a liquid containing an electrode material, and a bioorganic matter ejecting head for the chip manufacturing apparatus ejects a liquid containing a bioorganic matter.

The liquid ejecting head includes, for example, a nozzle board in which a plurality of nozzles are arranged side by side, a board on which a plurality of pressure chambers (or also referred to as pressure generation chambers or cavities) communicating with nozzles are formed, a board on which a supply liquid chamber (or also referred to as a reservoir or a manifold) is formed to be common to each pressure chamber into which a liquid from a liquid storage member is introduced, and a pressure generation element (or also referred to as a driving element or an actuator) such as a piezoelectric element, which causes pressure vibration in a liquid in the pressure chamber, in other words, a pressure change. Further, some liquid ejecting apparatuses including such a liquid ejecting head may be configured such that a plurality of head bodies (or heat units) having nozzle rows arranged side by side in a direction in which the nozzles are inclined with respect to a direction in which the medium is transported are arranged side by side in a direction perpendicular to the transport direction (for example, see JP-A-2015-136866). With this configuration, a flow path of the liquid flowing from a liquid storage member, such as a liquid tank and a liquid cartridge, which stores the liquid, to the nozzles of the liquid ejecting head is a one-way path. The liquid once supplied to the liquid ejecting head remains in the flow path inside the liquid ejecting head until the liquid is discharged from the nozzles.

In the above configuration, when bubbles are mixed with the liquid in the flow path inside the liquid ejecting head, the bubbles are unlikely to pass through a narrow flow path, and a buoyant force is applied. Therefore, the bubbles are unlikely to be discharged from the nozzle in a general liquid ejecting operation by driving the pressure generation element. Therefore, a so-called cleaning operation is required in which in order to discharge the bubbles, in a state in which a surface on which the nozzle is formed (hereinafter, also referred to as a nozzle surface) is sealed with a cap, a pressure difference between a space inside the cap and the inside of the flow path of the liquid ejecting head is caused with a pump or the like, so that the bubbles together with the liquid are discharged from the nozzle into the cap. However, there is a problem that the liquid is consumed more by the cleaning operation.

SUMMARY

According to an aspect of the present disclosure, in order to achieve the above purposes, there is provided a liquid ejecting head including a plurality of head units that eject a liquid from nozzles onto a medium relatively moved in a first direction, and that are arranged side by side in a second direction perpendicular to the first direction, in which each of the head units includes: a nozzle row in which a plurality of nozzles are arranged side by side along a third direction intersecting the first direction and the second direction; pressure chambers which communicate with the nozzles; pressure generation elements which cause a pressure change in the liquid inside the pressure chambers; a supply liquid chamber which communicates with the pressure chambers and into which the liquid to be supplied to each of the pressure chambers is introduced; an inflow port through which the liquid flows into the head unit; and an outflow port through which the liquid flows out of the head unit.

DESCRIPTION OF EXEMPLARY EMBODIMENTS

Hereinafter, embodiments for carrying out the present disclosure will be described with reference to the accompanying drawings. In embodiments described below, there are various limitations as exemplary specific examples of the present disclosure. However, the scope of the present disclosure is not limited to these embodiments unless stated to particularly limit the present disclosure in the following description. Further, in the following description, an ink jet recording apparatus equipped with an ink jet recording head (a liquid ejecting head 2) which is one kind of a liquid ejecting head will be described as one form of a liquid ejecting apparatus 1 according to the present disclosure.

Figure 1:
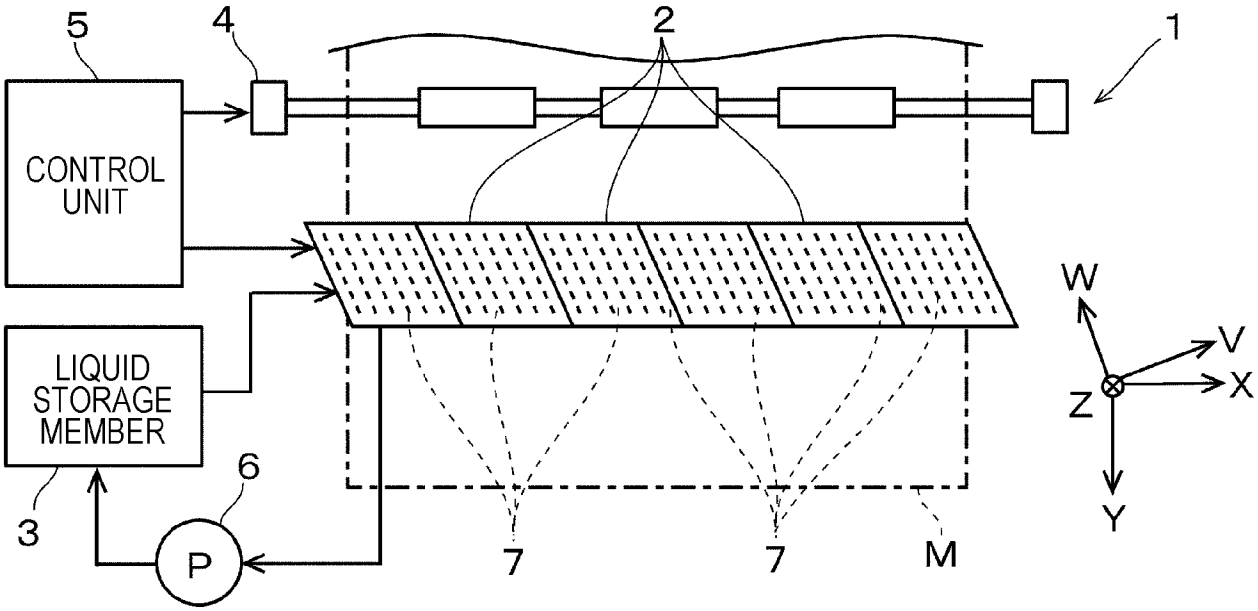
FIG. 1 is a schematic view illustrating a form of a configuration of a liquid ejecting apparatus.

FIG. 1 is a schematic view illustrating a form of a configuration of a liquid ejecting apparatus 1. The liquid ejecting apparatus 1 according to the present embodiment is an ink jet printing apparatus that ejects and lands ink droplets, which are one kind of a liquid, on a medium M such as recording paper and prints an image or the like by an array of dots formed on the medium. In the following description, among an X direction, an Y direction, and a Z direction perpendicular to each other, a transport direction of the medium M, that is, a relative movement direction of the medium M and the liquid ejecting head 2, is set as the Y direction (corresponding to a first direction in the present disclosure), a direction perpendicular to the transport direction is set as the X direction (corresponding to a second direction in the present disclosure), and a direction perpendicular to the XY plane is set as the Z direction. Further, a direction of a nozzle row 7 in which a plurality of nozzles 8 described below are arranged side by side, a direction that is perpendicular to the Z direction and is inclined with respect to the X direction and the Y direction, and a direction in which the nozzles 8 described below are juxtaposed (in other words, a nozzle row direction), are set as a W direction (corresponding to a third direction in the present disclosure). Further, a direction perpendicular to the W direction and the Z direction is appropriately referred to as a V direction (corresponding to a fourth direction in the present disclosure). Further, a tip end side of an arrow indicating a direction is set as a (+) direction, and a proximal end side of the arrow indicating the direction is set as a (−) direction. Inclination angles of the W direction with respect to the X direction and the Y direction illustrated in the following drawings are not necessarily matched with the actual ones, but are set according to the specifications of the liquid ejecting apparatus 1 and the like.

The liquid ejecting apparatus 1 includes a liquid ejecting head 2 including a plurality of the nozzle rows 7, a liquid storage member 3, a transport mechanism 4 that transports the medium M, a pump 6 through which an ink circulates between the liquid ejecting head 2 and the liquid storage member 3, and a control unit 5 that controls each portion of the liquid ejecting apparatus 1. The control unit 5 includes, for example, a processing circuit such as a central processing unit (CPU) and a field programmable gate array (FPGA) and a storage circuit such as a semiconductor memory, and comprehensively controls the transport mechanism 4, the pump 6, the liquid ejecting head 2, and the like in the liquid ejecting apparatus 1. The transport mechanism 4 transports the medium M in the Y direction from a paper feeding side to a paper discharging side under a control of the control unit 5. That is, the transport mechanism 4 relatively moves the liquid ejecting head 2 and the medium M in the Y direction. The liquid storage member 3 is a liquid storage member that may have various forms, such as a tank type, a cartridge type, and a pack type, which store ink ejected from the liquid ejecting head 2. The ink circulates between the liquid storage member 3 and the liquid ejecting head 2 by driving the pump 6 that functions as a liquid feeding mechanism. A liquid storage member serving as a buffer may be separately provided between the liquid storage member 3 and the liquid ejecting head 2. Further, a configuration may be employed in which the ink does not circulate between the liquid storage member 3 and the liquid ejecting head 2 and the ink individually circulates in each head unit 10.

Figure 2:
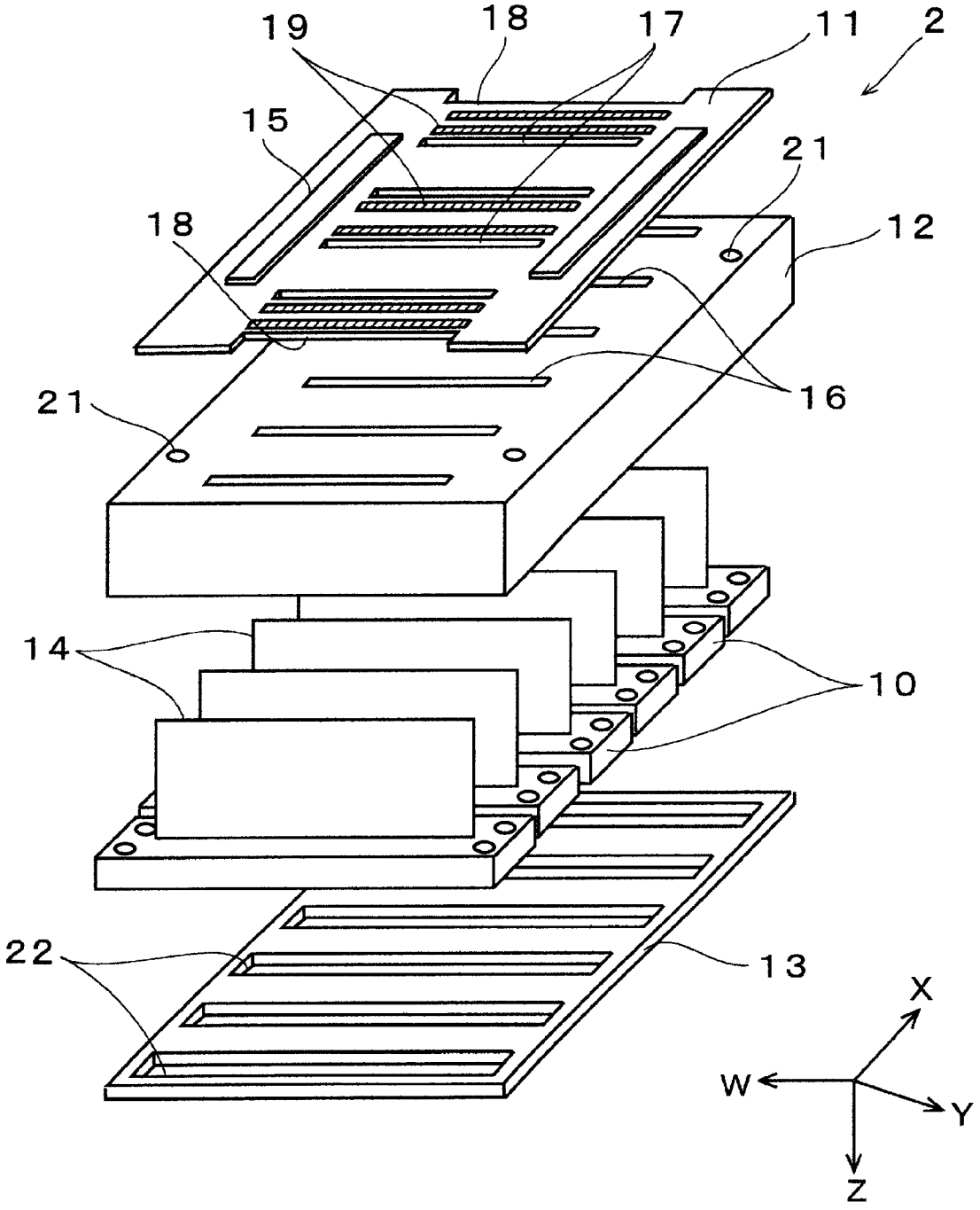
FIG. 2 is an exploded perspective view illustrating a configuration of a form of a liquid ejecting head.

FIG. 2 is an exploded perspective view of one form of the liquid ejecting head 2. In the present embodiment, the liquid ejecting head 2 includes a plurality of the head units 10 arranged in parallel to each other in the X direction, and the nozzles 8 included in the head units (in other words, unit heads) 10 are arranged at a constant pitch in the X direction. As illustrated in FIG. 1, a so-called line-type head can be configured by arranging a plurality of the liquid ejecting heads 2 in the X direction such that the total length of an array of the nozzles 8 in the X direction is equal to or larger than a maximum width of the medium M. In FIG. 2, a configuration including six head units 10 is illustrated. However, the number of the head units 10 is not limited to that illustrated, and may increase or decrease according to the specification of the liquid ejecting apparatus 1 as in the embodiments described below. Further, in FIG. 1, a configuration including six liquid ejecting heads 2 is illustrated. However, the number of the liquid ejecting heads 2 is not limited to that illustrated, and may increase or decrease according to the specification of the liquid ejecting apparatus 1 or the like. Furthermore, the line-type head can be configured by elongating a single liquid ejecting head such that the total length of the array of the nozzles 8 in the X direction is equal to or larger than the maximum width of the medium M.

In the present embodiment, the liquid ejecting head 2 includes the plurality of head units 10, a common wiring board 11, a flow path unit 12, and a fixing plate 13. In more detail, the head units 10 are joined to the fixing plate 13 in a state of being arranged side by side in the X direction, and the flow path unit 12 and the common wiring board 11 are sequentially stacked on the head units 10. Each head unit 10 is provided with a wiring member 14 having one end electrically coupled to a piezoelectric element 27 described below. The wiring member 14 is a flexible wiring material, such as a Chip On Film (COF), which electrically connects the piezoelectric element 27 of each head unit 10 and the common wiring board 11. Each wiring member 14 is inserted through a wiring entry port 16 formed in the flow path unit 12, and has the other end electrically joined to the common wiring board 11.

Figure 3:
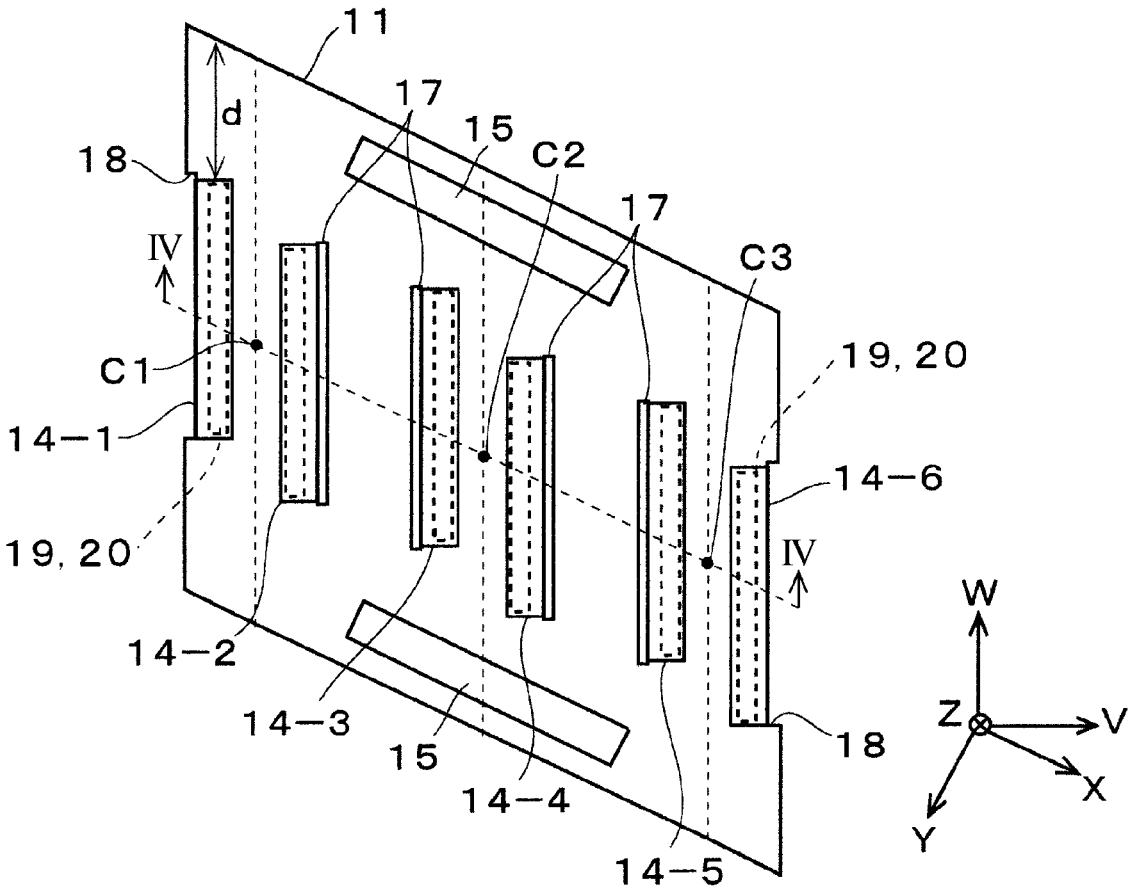
FIG. 3 is a plan view of a common wiring board.
Figure 4:
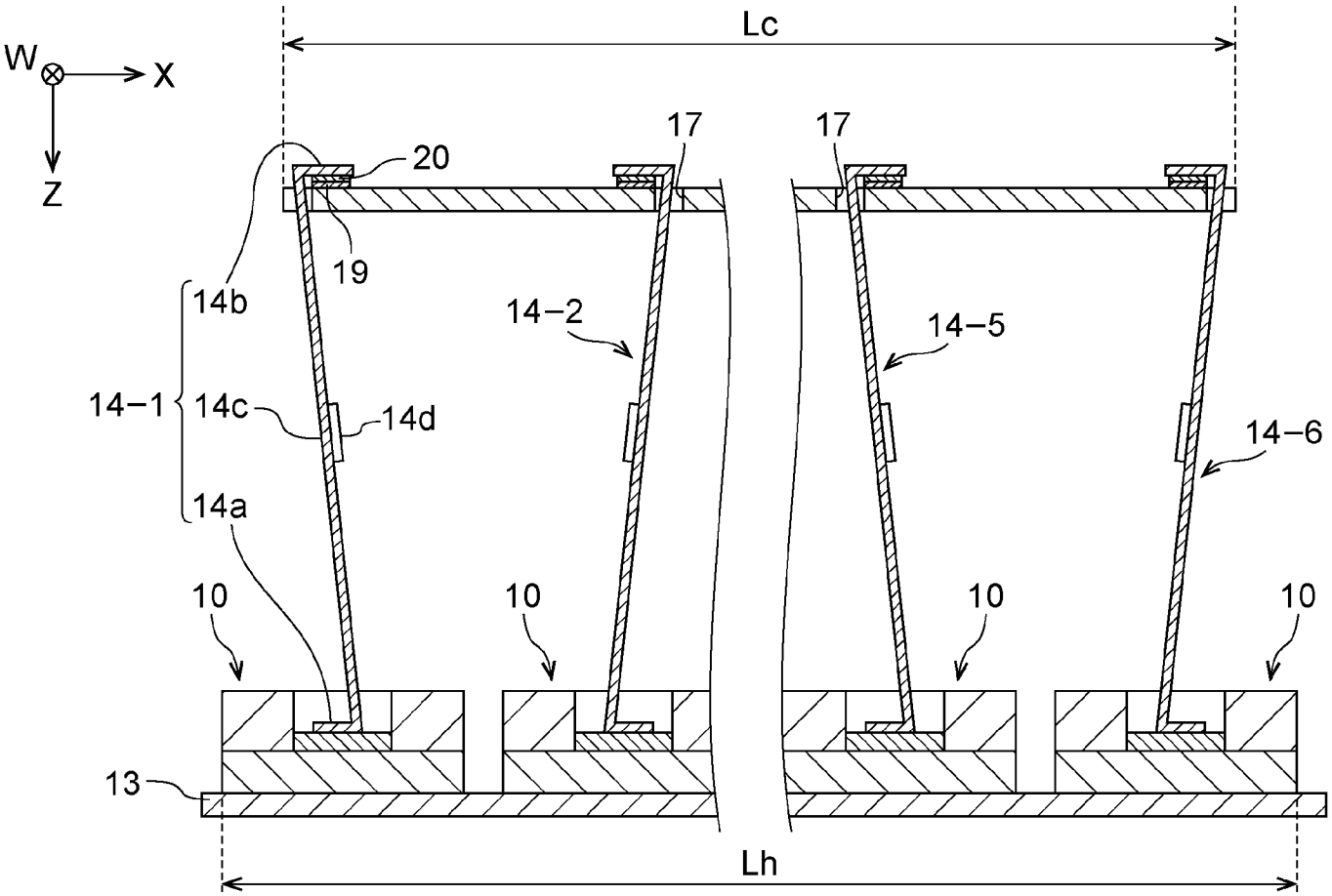
FIG. 4 is a schematic view for illustrating an arrangement layout of a common wiring board and a wiring member of a head unit.

FIG. 3 is a plan view of a common wiring board 11. Further, FIG. 4 is a schematic view for illustrating an arrangement layout of the common wiring board 11 and the wiring member 14 of each head unit 10, and is a view corresponding to a cross section taken along line IV-IV of FIG. 3. In FIG. 4, illustration of the flow path unit 12 and an opening portion 22 of the fixing plate 13 and illustration of an area corresponding to wiring members 14-3 and 14-4, which will be described below, (in other words, illustration of a central portion of the liquid ejecting head 2 in the X direction) will be omitted. Further, in FIG. 3, an upper left side is set as one side in the X direction, a lower right side is set as the other side in the X direction, an upper side is set as one side in the W direction, and a lower side is set as the other side in the W direction. Similarly, in FIG. 4, a left side is set as one side in the V direction, and a right side is set as the other side in the V direction. However, an end of each member on one side in each direction is appropriately set as one end, and an end of each member on the other side in each direction is appropriately set as the other end.

The common wiring board 11 is a board provided with a connector 15 to which wiring, such as printed wiring that is not illustrated and FFC that is not illustrated and is electrically coupled to the control unit 5, is coupled. In the present embodiment, a plurality of board terminal portions 19, in which a plurality of terminals for electrical connection to the wiring members 14 of the head units 10 are arranged side by side in the W direction, are provided on the upper surface of the common wiring board 11, that is, a surface opposite to a lower surface facing the flow path unit 12, to correspond to the head units 10, respectively. A distance d from one end of the board terminal portion 19 to one end of the common wiring board 11 (in other words, one side edge of the common wiring board 11 in the Y direction) in the W direction is made uniform at each board terminal portion 19. That is, the board terminal portions 19 are arranged side by side in the X direction along a side edge of the common wiring board 11. Further, concave notch portions 18 are formed on both side edges of the common wiring board 11 in the X direction. The dimension of the notch portion 18 in the W direction is set slightly larger than the width of the wiring member 14 in the W direction. The wiring member 14 (in the present embodiment, a wiring member 14-1 and a wiring member 14-6) coupled to the head units 10 located at opposite end portions in the X direction among the plurality of head units 10 is arranged in this notch portion 18. Among them, the board terminal portion 19 is formed adjacent to the other notch portion 18 in the V direction with respect to the one notch portion 18 in the X direction. Similarly, the board terminal portion 19 is formed adjacent to the one notch portion 18 in the V direction with respect to the other notch portion 18 in the X direction. That is, the board terminal portions 19 are formed adjacent to a central axis of the common wiring board 11 indicated by a point C2 in the drawings with respect to the notch portion 18. Further, in an area between the notch portions 18 of the common wiring board 11 in the X direction, wiring insertion ports 17, into which the wiring member 14 of the remaining head units 10 except for the head units 10 located at both ends in the X direction among the head units 10 are inserted, are formed to correspond to the board terminal portions 19, respectively. In a positional relationship between the wiring insertion port 17 and the board terminal portion 19, the even-numbered board terminal portions 19 counted from one end in the X direction are located on sides of the wiring insertion ports 17 in the X direction, respectively, and the odd-numbered board terminal portions 19 are located on the other sides of the wiring insertion ports 17 in the X direction, respectively.

The wiring member 14 has a first connection portion 14*a*, a second connection portion 14*b*, and a relay portion 14*c*. The first connection portion 14*a* and the second connection portion 14*b* are portions located at both ends of the wiring member 14. That is, in the wiring member 14, the relay portion 14*c* is located between the first connection portion 14*a* and the second connection portion 14*b*. As illustrated in FIG. 4, the first connection portion 14*a* and the second connection portion 14*b* are bent to be opposite to each other at a boundary with the relay portion 14*c*. The first connection portion 14*a* is electrically coupled to each piezoelectric element 27 of the head unit 10, which will be described below. The second connection portion 14*b* is formed with a wiring terminal portion 20 in which a plurality of terminals electrically coupled to the board terminal portion 19 of the common wiring board 11 are provided side by side. Further, an IC chip 14*d* is mounted on the relay portion 14*c*. The IC chip 14*d* controls application of a drive signal to each piezoelectric element 27 based on a control signal and a power supply voltage supplied from the common wiring board 11.

In the above configuration, similar to the odd-numbered wiring members 14-1, 14-3, and 14-5 counted from one end in the X direction, as illustrated in FIG. 3, the even-numbered wiring members 14-2, 14-4, and 14-6 are arranged to be point-symmetric to each other when viewed from the Z direction. That is, as illustrated in FIG. 4, the odd-numbered wiring member 14-1 and the even-numbered wiring member 14-2 are arranged to be point-symmetric to each other with respect to a point C1 that is an intersection point between a virtual central line extending in the X direction through the point C2 that is a central point of the common wiring board 11 and a virtual central line extending in the W direction between the board terminal portions 19 to which the wiring members 14-1 and 14-2 are coupled. In other words, when viewed in the W direction, the wiring member 14-1 and the wiring member 14-2 are arranged to be line-symmetric to each other with respect to a virtual line extending in the Z direction between the board terminal portions 19 to which the wiring member 14-1 and the wiring member 14-2 are coupled. Similarly, the odd-numbered wiring member 14-3 and the even-numbered wiring member 14-4 are arranged to be point-symmetric to each other with respect to the point C2, and are arranged to be line-symmetric to each other with respect to a virtual line extending in the Z direction when viewed from the W direction. Further, the odd-numbered wiring member 14-5 and the even-numbered wiring member 14-6 are arranged to be point-symmetric to each other with respect to the point C3, and are arranged to be line-symmetric to each other with respect to a virtual line extending in the Z direction when viewed from the W direction. That is, the odd-numbered wiring member 14 and the even-numbered wiring member 14, which are adjacent to each other, are arranged in a state in which tip ends of the second connection portions 14*b* of the odd-numbered wiring member 14 and the even-numbered wiring member 14 face each other. When the number of the wiring members 14 coupled to the common wiring board 11 is an odd number, the wiring members 14 located at both ends in the X direction may be arranged to be point-symmetric to each other in a state in which tip ends of the second connection portions 14*b* bent along a wiring surface of the common wiring board 11 (that is, in the present embodiment, the upper surface) face each other.

By adopting such a configuration, the tip ends of the second connection portions 14*b* of the wiring members 14 located at both ends in the X direction among the plurality of wiring members 14 coupled to the common wiring board 11 face the inner side in the X direction (that is, the center side of the common wiring board 11). Thus, in the common wiring board 11, a space for arranging wirings, terminals, and the like outside the wiring members 14 located at both ends in the X direction becomes unnecessary. Accordingly, the size of the common wiring board 11 can be reduced to that extent. As a result, the size of the liquid ejecting head 2 can be reduced. That is, as illustrated in FIG. 4, the length Lc of the common wiring board 11 in the X direction can be set within an arrangement area (area indicated by Lh in FIG. 4) of each head unit 10. Accordingly, when the plurality of liquid ejecting heads 2 are arranged side by side in the X direction, the liquid ejecting heads 2 can be brought closer to each other without the common wiring boards 11 interfering with each other. As a result, the nozzles 8 of the head units 10 provided in the plurality of liquid ejecting heads 2 can be arranged in parallel to each other at a constant pitch in the X direction as a whole. Further, since the wiring member 14 of the head unit 10 can be shared, costs can be reduced to that extent.

The flow path unit 12 disposed between the common wiring board 11 and the head unit 10 is a structure having a flow path formed herein, and distributes the ink supplied from a supply port 21 to the head unit 10. The fixing plate 13 is a flat plate member that supports the head unit 10, and is formed of, for example, a metal plate such as stainless steel. The fixing plate 13 is formed with a plurality of the opening portions 22 corresponding to the plurality of head units 10, respectively. When the head unit 10 is joined to the fixing plate 13 in a state in which the head unit 10 is positioned, the opening portion 22 is configured such that the nozzle 8 of the head unit 10 is exposed to the lower surface of the fixing plate 13, that is, a surface facing the medium M during a printing operation. In the drawing, a configuration including six head units 10 is illustrated. However, the number of the head units 10 is not limited to that illustrated, and may increase or decrease according to the specification of the liquid ejecting apparatus 1 as in the embodiments described below.

Figure 5:
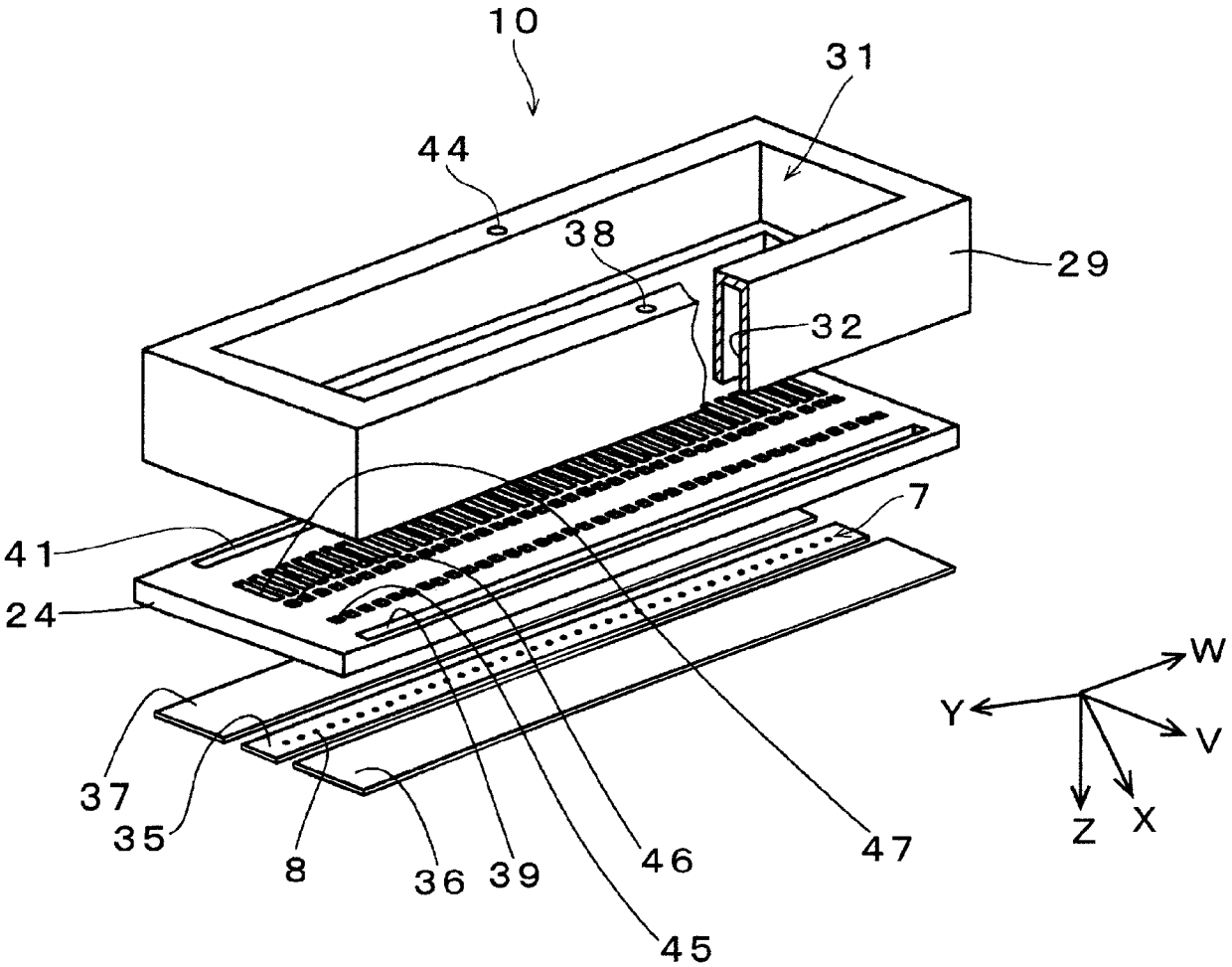
FIG. 5 is an exploded perspective view of a configuration of one form of the head unit.
Figure 6:
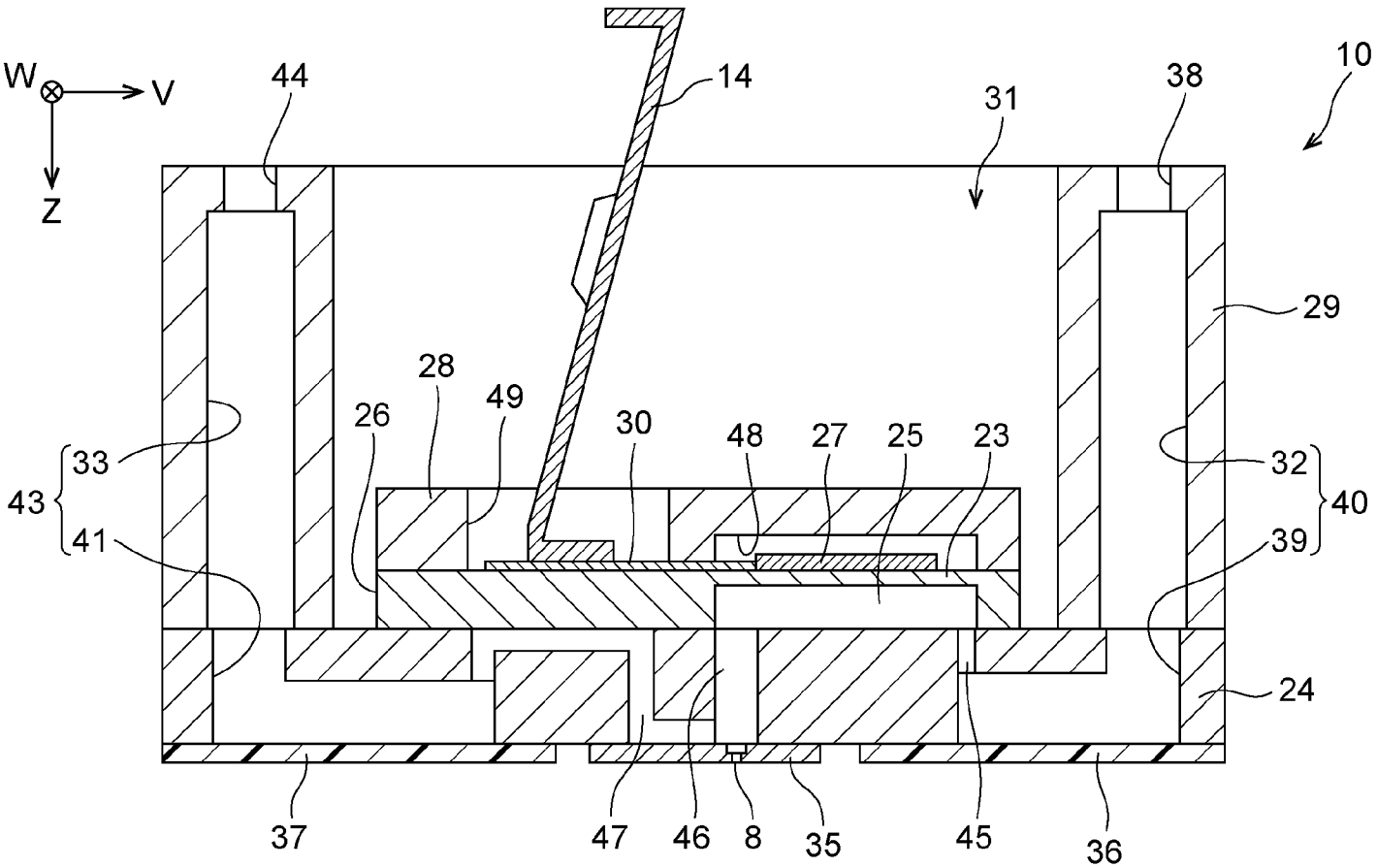
FIG. 6 is a cross-sectional view of the head unit in a V direction.

FIG. 5 is an exploded perspective view of one form of the head unit 10. Further, FIG. 6 is a cross-sectional view of the head unit 10 in the V direction. In FIG. 5, illustration of the wiring member 14 is omitted. The head unit 10 in the present embodiment includes a flow path board 24 in which various flow paths are formed, a pressure chamber board 26 in which a pressure chamber 25 is formed, a protective board 28 which protects the piezoelectric element 27, and a common flow path board 29 having a liquid chamber (described later) common to the nozzles 8.

The flow path board 24 in the present embodiment is formed of, for example, a silicon single crystal board, and has a common introduction liquid chamber 39, a first individual communication path 45, a nozzle communication path 46, a second individual communication path 47, and a common discharge liquid chamber 41. The pressure chamber board 26 and the protective board 28 are joined to each other on the upper surface of the flow path board 24 in the Z direction while being stacked in the order thereof. Further, as described below, in a state in which the pressure chamber board 26 and the protective board 28 are accommodated in a wiring space 31, the common flow path board 29 is bonded. Further, a nozzle board 35 is joined to a central portion in the X direction on the lower surface of the flow path board 24 in the Z direction. A first compliance board 36 and a second compliance board 37 are joined to both sides of the nozzle board 35 pinched therebetween.

The common introduction liquid chamber 39 is a liquid chamber that extends in a nozzle row direction in which the nozzles 8 are arranged side by side, in other words, along the W direction, and communicates with a plurality of the pressure chambers 25. An opening of the common introduction liquid chamber 39 on the upper surface of the flow path board 24 communicates with an introduction liquid chamber 32 of the common flow path board 29. Further, the opening of the common introduction liquid chamber 39 on the lower surface of the flow path board 24 is closed by the first compliance board 36 which is joined to the lower surface of the flow path board 24 and will be described below. The first individual communication path 45 is a flow path through which the plurality of pressure chambers 25 formed on the pressure chamber board 26 and the common introduction liquid chamber 39 (that is, a supply liquid chamber 40) individually communicate with each other. A plurality of the individual communication paths 45 are provided to correspond to the pressure chambers 25. In other words, the first individual communication path 45 is a flow path communicating with the pressure chamber 25 from the supply liquid chamber 40. The first individual communication path 45 has a flow path cross-section that is smaller than that of the other portion of the flow path from the liquid storage member 3 toward the pressure chamber 25, and thus imparts flow path resistance to the ink passing through the first individual communication path 45.

The nozzle communication path 46 is a flow path penetrated in the thickness direction of the flow path board 24, and causes the nozzle 8 of the nozzle board 35 joined to the lower surface of the flow path board 24 and the pressure chamber 25 corresponding to the nozzle 8 to communicate with each other. The second individual communication path 47 is a flow path individually formed to correspond to each nozzle 8. One end of the second individual communication path 47 communicates with the nozzle communication path 46. Further, the other end of the second individual communication path 47 communicates with the common discharge liquid chamber 41 (in other words, a discharge liquid chamber 43 described later). The first individual communication path 45, the pressure chamber 25, the nozzle communication path 46, and the second individual communication path 47 in the present embodiment are individual flow paths individually provided in each nozzle 8.

The common discharge liquid chamber 41 is a liquid chamber extending in the W direction, and communicates with the plurality of nozzles 8 through the second individual communication path 47. That is, the common discharge liquid chamber 41 is a liquid chamber common to the plurality of nozzles 8. An opening on the upper surface side of the common discharge liquid chamber 41 in the flow path board 24 communicates with a discharge liquid chamber 33 of the common flow path board 29. An opening on the lower surface side of the common discharge liquid chamber 41 in the flow path board 24 is closed by the second compliance board 37.

The pressure chamber board 26 is a plate-like member having an area that is smaller than the common flow path board 29 in a plan view from the Z direction, and is formed of a silicon single crystal board or the like, which is like the common flow path board 29. The pressure chamber 25 formed on the pressure chamber board 26 is a liquid chamber that is elongated in the V direction perpendicular to the W direction, and is open on the lower surface of the pressure chamber board 26. As the pressure chamber board 26 is joined to the upper surface of the flow path board 24, the opening is closed and the pressure chamber 25 is defined. One end (a right end in FIG. 6) of the pressure chamber 25 in the V direction communicates with the common introduction liquid chamber 39 (in other words, the supply liquid chamber 40 described later) through the first individual communication path 45 of the flow path board 24. Further, the other end (a left end in FIG. 6) of the pressure chamber 25 in the V direction communicates with the nozzles 8 of the nozzle board 35 through the nozzle communication path 46 of the flow path board 24.

In the pressure chamber board 26, a flexible diaphragm 23 is provided on the upper surface side of the pressure chamber 25. The diaphragm 23 is a portion formed in a thin plate shape that is displaceable according to driving of the piezoelectric element 27 functioning as a pressure generation element. The piezoelectric element 27 is formed in a portion corresponding to the pressure chamber 25 on the diaphragm 23. The piezoelectric element 27 is a drive element individually provided to correspond to the pressure chamber 25 and is deformed in response to a drive signal from the control unit 5. As the diaphragm 23 is deformed with the deformation of the piezoelectric element 27, the volume of the pressure chamber 25 increases or decreases. Accordingly, pressure vibration (in other words, pressure change) occurs in the ink in the pressure chamber 25. In the head unit 10, droplets, that is, ink droplets, are ejected from the nozzles 8 using the pressure vibration.

The first compliance board 36 is a board that absorbs the pressure vibration propagating from the pressure chamber 25 side into the supply liquid chamber 40, which will be described below, when the ink droplets are ejected from the nozzles 8, and suppresses variations in ejection characteristics (that is, the amount, the ejection speed or the like of the ink droplets) between the nozzles 8. The first compliance board 36 and the second compliance board 37, which will be described below, have flexible film-like thin films (for example, thin films formed of polyphenylene sulfide (PPS), aromatic polyamide (aramid), or the like) that is not illustrated. The thin film absorbs the pressure vibration by being displaced according to the pressure vibration of the ink in the liquid chamber.

The nozzle board 35 is joined to the lower surface of the flow path board 24 and closes the openings of the nozzle communication path 46 and the second individual communication path 47. In the nozzle board 35 in the present embodiment, for example, as drying etching, wet etching or the like are performed on a silicon (Si) single crystal board, the plurality of nozzles 8 are arranged side by side at a predetermined pitch to form the nozzle row 7. The nozzle 8 is a circular through-hole that ejects the ink, and various already-known shapes can be employed as the nozzle 8. In FIGS. 5 and 6, only one nozzle row 7 is illustrated on the nozzle board 35. However, as will be described below, a configuration in which two nozzle rows 7 are provided may be employed (see FIG. 12).

The protective board 28 is formed with a concave accommodation space 48 corresponding to a formation area of the piezoelectric element 27 provided on the diaphragm 23 of the pressure chamber board 26. The protective board 28 is joined to the upper surface of the pressure chamber board 26 to accommodate the piezoelectric element 27 in the accommodation space 48. Further, the protective board 28 has a wiring through-hole 49 penetrated in a board thickness direction for the purpose of installation of the wiring member 14 coupled to a lead electrode 30 pulled out from the piezoelectric element 27.

The common flow path board 29 has a wiring space 31 penetrated in the height direction (that is, the Z direction) in a central portion. Further, in a state in which the common flow path board 29 is joined to the flow path board 24, the pressure chamber board 26 and the protective board 28 provided on the upper surface of the flow path board 24 are stacked and arranged in the wiring space 31 of the common flow path board 29. Further, the wiring member 14 coupled to the piezoelectric element 27 is disposed in the wiring space 31.

In the common flow path board 29, the introduction liquid chamber 32 and the discharge liquid chamber 33 are formed on both sides of the wiring space 31 in the X direction, respectively. The introduction liquid chamber 32 is open on the lower surface of the common flow path board 29, and the opening is closed by the flow path board 24 and communicates with the common introduction liquid chamber 39 formed in the flow path board 24. The common introduction liquid chamber 39 and the introduction liquid chamber 32 communicate with each other in series to partition one supply liquid chamber 40. The supply liquid chamber 40 is a liquid chamber shared for supplying the ink to the plurality of pressure chambers 25. Similarly, the discharge liquid chamber 33 is open on the lower surface of the common flow path board 29, and communicates with the common discharge liquid chamber 41 of the flow path board 24 to partition the discharge liquid chamber 43. The discharge liquid chamber 43 is a liquid chamber into which the ink that has not been ejected from the nozzle 8 flows from the supply liquid chamber 40 through an individual flow path such as the pressure chamber 25.

An inflow port 38 communicating with the supply liquid chamber 40 and an outflow port 44 communicating with the discharge liquid chamber 43 are formed on the upper surface of the common flow path board 29. That is, the inflow port 38 is a through-hole through which the ink flows into the head unit 10, and the outflow port 44 is a through-hole through which the ink flows out of the head unit 10. The formation positions and the numbers of the inflow ports 38 and the outflow ports 44 differ depending on embodiments described below.

Next, in the embodiment of the liquid ejecting apparatus 1 according to the present disclosure, arrangement of the nozzles 8 and the nozzle rows 7 and circulation of the ink will be described mainly.

Figure 7:
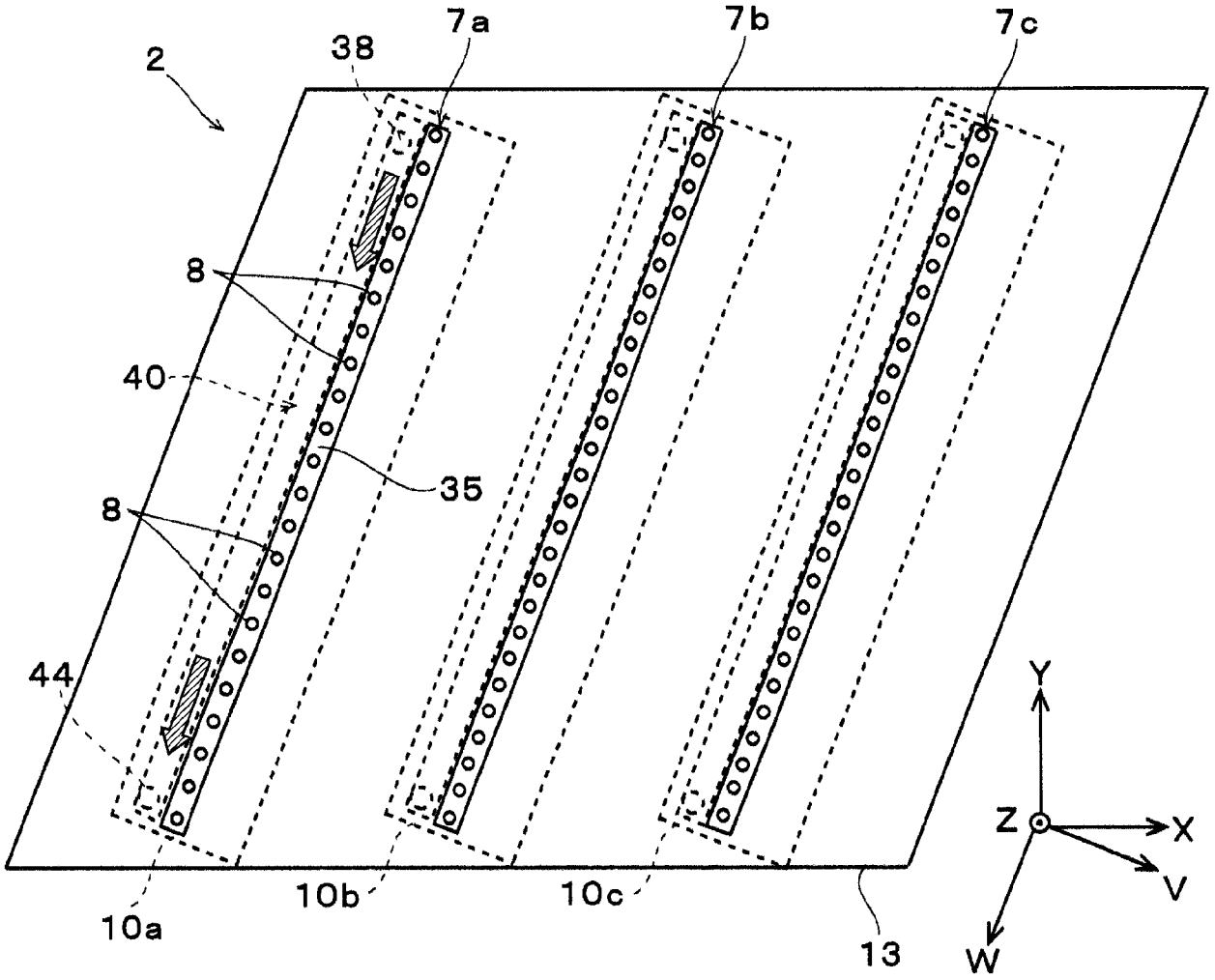
FIG. 7 is a plan view of a liquid ejecting head according to a first embodiment when viewed from the +Z direction.
Figure 8:
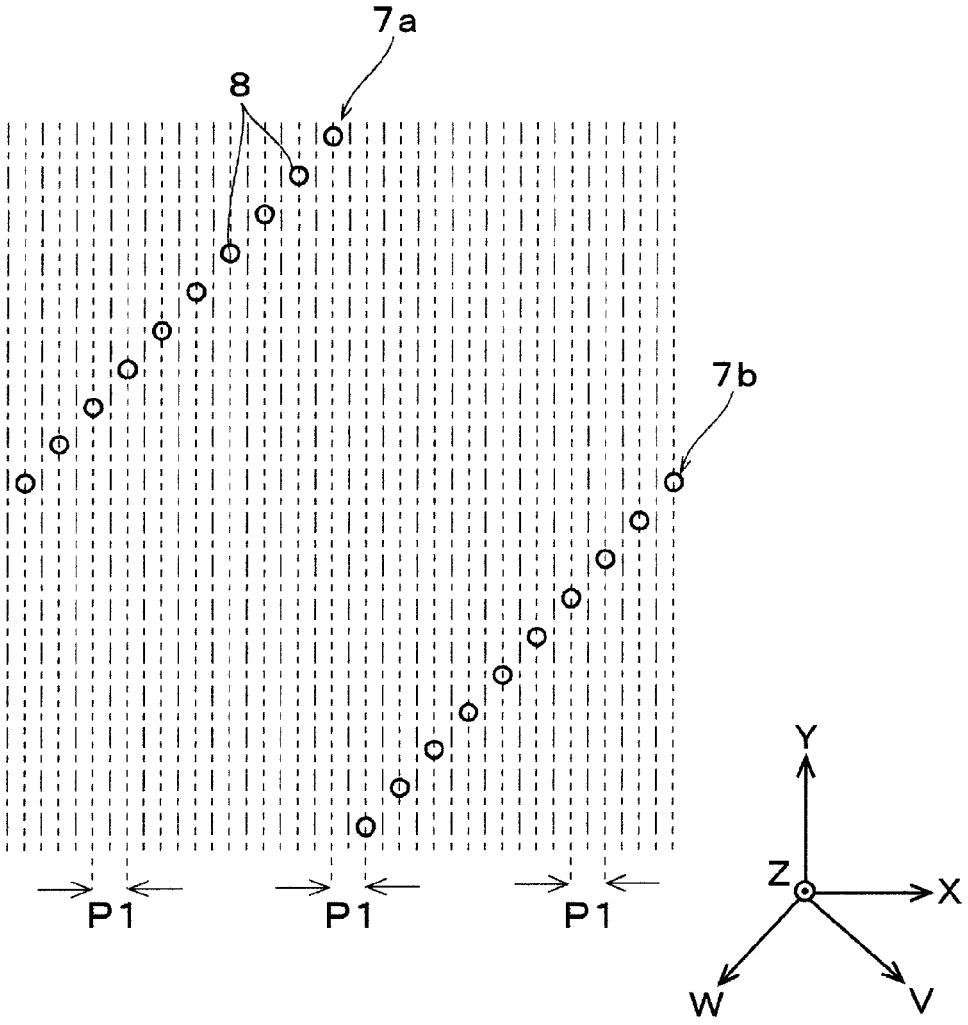
FIG. 8 is a schematic view for illustrating a positional relationship of nozzles between nozzle rows in the first embodiment.

FIG. 7 is a plan view of the liquid ejecting head 2 according to the first embodiment when viewed from the +Z direction, and is particularly a view schematically illustrating how the ink circulates. In FIG. 7, a state in which the fixing plate 13 is seen through is shown, and illustration of the opening portion 22 of the fixing plate 13 is omitted. Further, in FIG. 7, the liquid ejecting head 2, the inflow port 38, the outflow port 44, and the supply liquid chamber 40 are illustrated by broken lines. FIG. 8 is a schematic view for illustrating a positional relationship of nozzles 8 between nozzle rows 7 in the first embodiment.

In the present embodiment, in the liquid ejecting head 2, three head units 10*a* to 10*c* are arranged side by side in the X direction, and each of the head units 10*a* to 10*c* includes one nozzle row 7. The nozzle rows 7*a* to 7*c* of the head units 10 are formed along the W direction that is perpendicular to the Z direction and is inclined with respect to the X direction and the Y direction, and any of them ejects the same kind of ink, that is, ink having the same color (for example, black). As illustrated in FIG. 8, the plurality of nozzles 8 constituting the same nozzle row 7 are arranged in parallel to each other at a constant pitch P1 (in other words, a distance between the centers of the nozzles 8 adjacent to each other in the X direction) in the X direction when viewed from the Y direction. In the present embodiment, for example, P1 is set to an interval corresponding to 600 dpi, which is a formation density of landing dots of the ink on the medium M. Further, the nozzle 8 located at one end (an upper right side in FIG. 7) of the nozzle row 7 of one head unit 10 (a left side in FIG. 7) in the W direction in the head units 10 adjacent to each other in the X direction and the nozzle 8 located at the other end (a lower left side in FIG. 7) of the nozzle row 7 of the other head unit 10 (a right side in FIG. 7) in the W direction are arranged at the constant pitch P1 in the X direction, as illustrated in FIG. 8. That is, the nozzles 8 formed in each of the head units 10*a* to 10*c* are arranged to continuous at the constant pitch P1 in the X direction when viewed from the Y direction. In this case, the term "continuous" means that an interval between the nozzles 8 adjacent to each other in the X direction is not more than the P1. In this way, the nozzle rows 7*a* to 7*c* of the head unit 10 are arranged along the W direction that is inclined with respect to the Y direction that is the transport direction of the medium M and the X direction perpendicular to the Y direction. Thus, while the head unit 10 and the liquid ejecting head 2 provided in the head unit 10 are downsized, the nozzles 8 of the adjacent head units 10 can be continuously coupled to each other at the constant pitch P1 in the X direction. When the nozzles 8 are arranged at the constant pitch P1 in the X direction as a whole, the nozzles 8 of the adjacent head units 10 may be arranged to overlap each other when viewed from the Y direction. Even in this case, it can be said that the nozzles 8 are continuously arranged in the X direction.

Further, in the present embodiment, only the supply liquid chamber 40 in the head unit 10 is used, and the discharge liquid chamber 43 and the second individual communication path 47 are not used. The supply liquid chamber 40 in the present embodiment is provided with both the inflow port 38 and the outflow port 44. In an example of FIG. 7, the inflow port 38 is provided at one end of the supply liquid chamber 40 in the W direction, and the outflow port 44 is provided at the other end of the supply liquid chamber 40 in the W direction.

In the present embodiment, during the printing operation by the liquid ejecting head 2, the ink circulates by driving the pump 6 between the liquid storage member 3 and the supply liquid chamber 40 of the head unit 10. That is, the ink sent from the liquid storage member 3 is introduced into the supply liquid chamber 40 from the inflow port 38. The ink in the supply liquid chamber 40 is supplied to the pressure chamber 25 through the first individual communication path 45 (see FIG. 6). The ink introduced into the supply liquid chamber 40 from the inflow port 38 flows from the one end toward the other end of the supply liquid chamber 40 along the W direction that is a direction of the nozzle row 7, as indicated by hatching an arrow in FIG. 7. The ink that has not been ejected from the nozzle 8 is sent out from the outflow port 44 provided at the other end of the supply liquid chamber 40 and returns to the liquid storage member 3. While the pump 6 is driven, the ink continuously circulates between the inflow port 38 and the outflow port 44. For example, the ink sent out to the liquid storage member 3 passes through a filter, so that bubbles contained in the ink are removed.

In this way, in a configuration of the present embodiment, the supply liquid chamber 40 is provided with the inflow port 38 and the outflow port 44, and the ink can circulate therebetween. Thus, even when bubbles are generated in a flow path inside the head unit 10, the bubbles can be discharged to the outside of the head unit 10. As a result, the number of times of so-called maintenance operations, such as a cleaning operation and a flushing operation, for forcibly discharging the ink inside the head unit 10 from the nozzle 8 can be reduced, and the amount of the ink consumed in the maintenance operation can be reduced. Further, since the supply liquid chamber 40 is provided with the inflow port 38 and the outflow port 44, the discharge liquid chamber 43 and the second individual communication path 47 are not required. Since the head unit 10 can be downsized to that extent, a configuration can be employed in which the ink circulates in a smaller space.

In the present embodiment, a configuration in which the ink circulates between the liquid storage member 3 and the supply liquid chamber 40 of the head unit 10 is illustrated. However, the present disclosure is not limited thereto. For example, a configuration may be employed in which a circulation flow path connecting the inflow port 38 and the outflow port 44, a filter provided in the circulation flow path, and a circulation pump are provided in the head unit 10, and the ink circulates without using the liquid storage member 3. In this case, an introduction port for introducing the ink from the liquid storage member 3 into the supply liquid chamber 40 is provided separately from the inflow port 38. Further, the positions of the inflow port 38 and the outflow port 44 in the supply liquid chamber 40 are not limited to the illustrated configuration. For example, a positional relationship between the inflow port 38 and the outflow port 44 may be opposite to that illustrated in FIG. 7. Accordingly, in this case, a direction in which the ink flowing from the inflow port 38 flows toward the outflow port 44 is opposite to the direction illustrated in FIG. 7.

Figure 9:
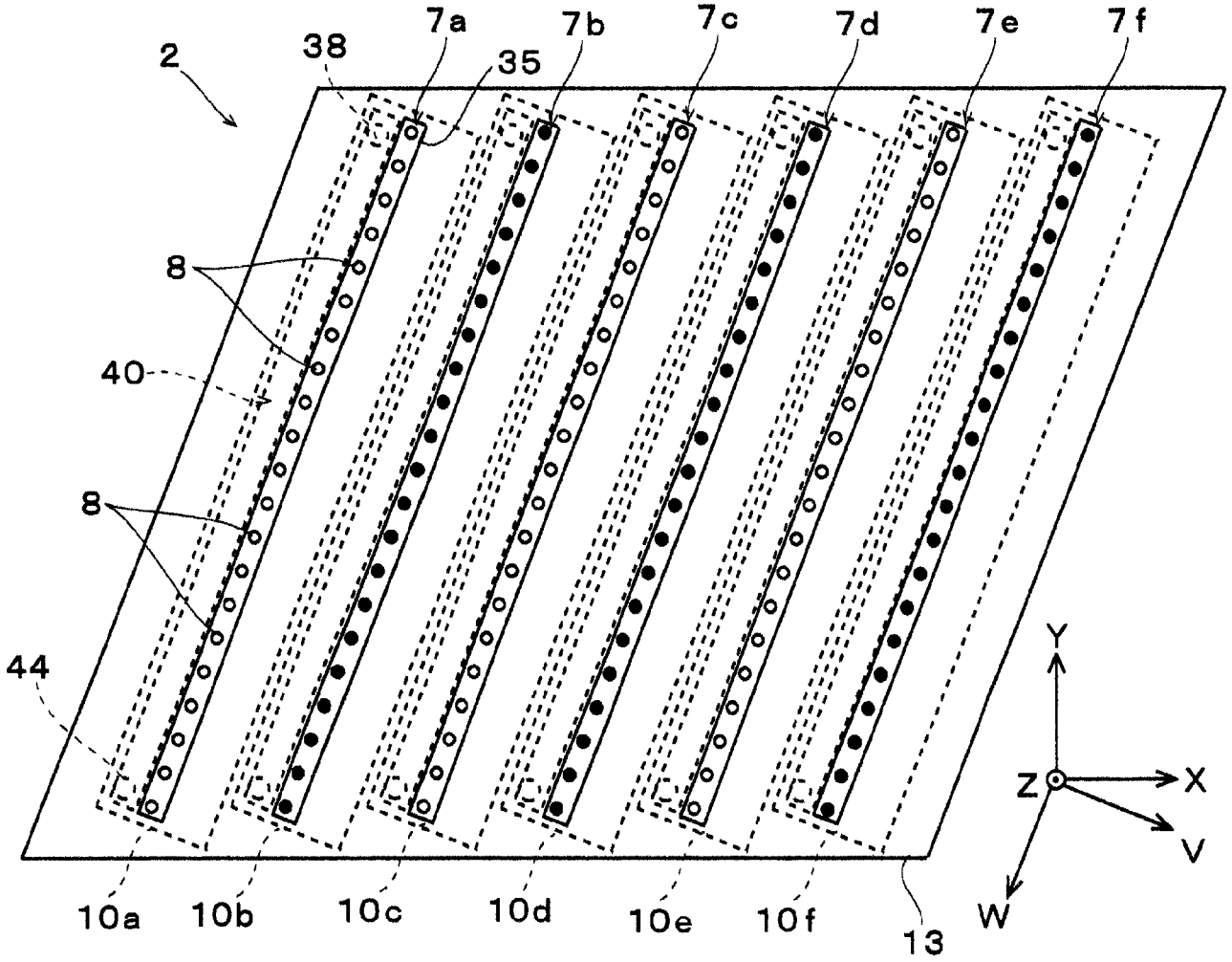
FIG. 9 is a plan view of a liquid ejecting head according to a first modification example of the first embodiment when viewed from the +Z direction.
Figure 10:
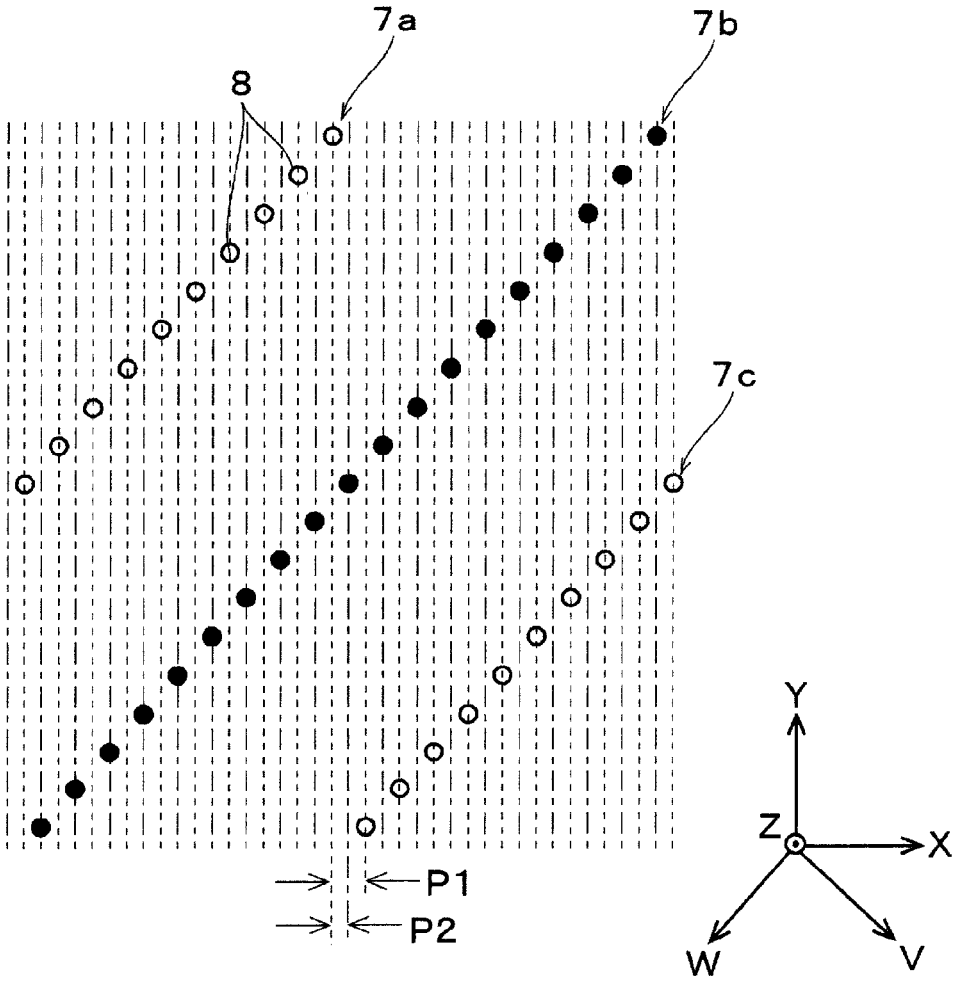
FIG. 10 is a schematic view for illustrating a positional relationship of nozzles between nozzle rows in the first modification example of the first embodiment.

FIG. 9 is a view corresponding to FIG. 7, and a plan view of the liquid ejecting head 2 according to a first modification example of the first embodiment when viewed from the +Z direction. Further, FIG. 10 is a schematic view for illustrating a positional relationship between the nozzles 8 of the nozzle rows 7 in the first modification example. In the liquid ejecting head 2 according to the present embodiment, a total of 6 head units 10*a* to 10*f* are arranged side by side in the X direction, and each of the head units 10*a* to 10*f* includes one nozzle row 7. In detail, nozzle rows 7*a* to 7*f* are provided from one end (a left end in the drawing) toward the other end (a right end in the drawing) in the X direction.

In the present embodiment, odd-numbered nozzle rows 7*a*, 7*c*, and 7*e* in which the nozzles 8 are indicated by white circles in FIG. 9, and even-numbered nozzle rows 7*b*, 7*d*, and 7*f* in which the nozzles 8 are indicated by black circles in the same drawing eject different types of ink (that is, ink having different colors). That is, in the present embodiment, the liquid ejecting head 2 is configured to eject two types of ink. Further, the nozzle 8 located at one end (an upper right side in the drawing) of one nozzle row 7, in the W direction, among the adjacent odd-numbered nozzle rows 7, and the nozzle 8 located at the other end (a lower left side in the drawing) of the other nozzle row 7 (a right side in the drawing) in the W direction are arranged at the constant pitch P1 in the X direction, as illustrated in FIG. 10. Similarly, the nozzle 8 located at one end of one nozzle row 7, in the W direction, among the adjacent even-numbered nozzle rows 7, and the nozzle 8 located at the other end of the other nozzle row 7 in the W direction are arranged at the pitch P1 in the X direction. That is, the nozzle 8 for each color are continuous at the constant pitch P1 in the X direction when viewed from the Y direction. Further, as illustrated in FIG. 10, the nozzles 8 of the odd-numbered nozzle rows 7 and the nozzles 8 of the even-numbered nozzle rows 7 are arranged at a pitch P2 that is a half of the pitch P1 in the X direction. The other configurations such as a configuration for the circulation of the ink are the same as those in the first embodiment.

In the first modification example, a configuration is exemplified in which the odd-numbered nozzle rows 7*a*, 7*c*, and 7*e* in which the nozzles 8 are indicated by white circles in FIG. 9 and the even-numbered nozzles 7*b*, 7*d*, and 7*f* in which the nozzles 8 are indicated by black circles in the same drawing eject different types of ink. However, the present disclosure is not limited to this configuration, and a configuration in which the nozzle rows 7*a* to 7*f* eject the same type of ink can be employed as a second modification example of the first embodiment. In this case, as illustrated in FIG. 10, in an area in which formation areas of the nozzle rows 7 overlap each other when viewed from the Y direction, the nozzle density in the X direction when the nozzles 8 are arranged at the pitch P2 (for example, a pitch corresponding to 1200 dpi) in the X direction is doubled as compared to a configuration in which the nozzles 8 are arranged at the pitch P1. Therefore, printing and recording can be performed with higher resolution.

Figure 11:
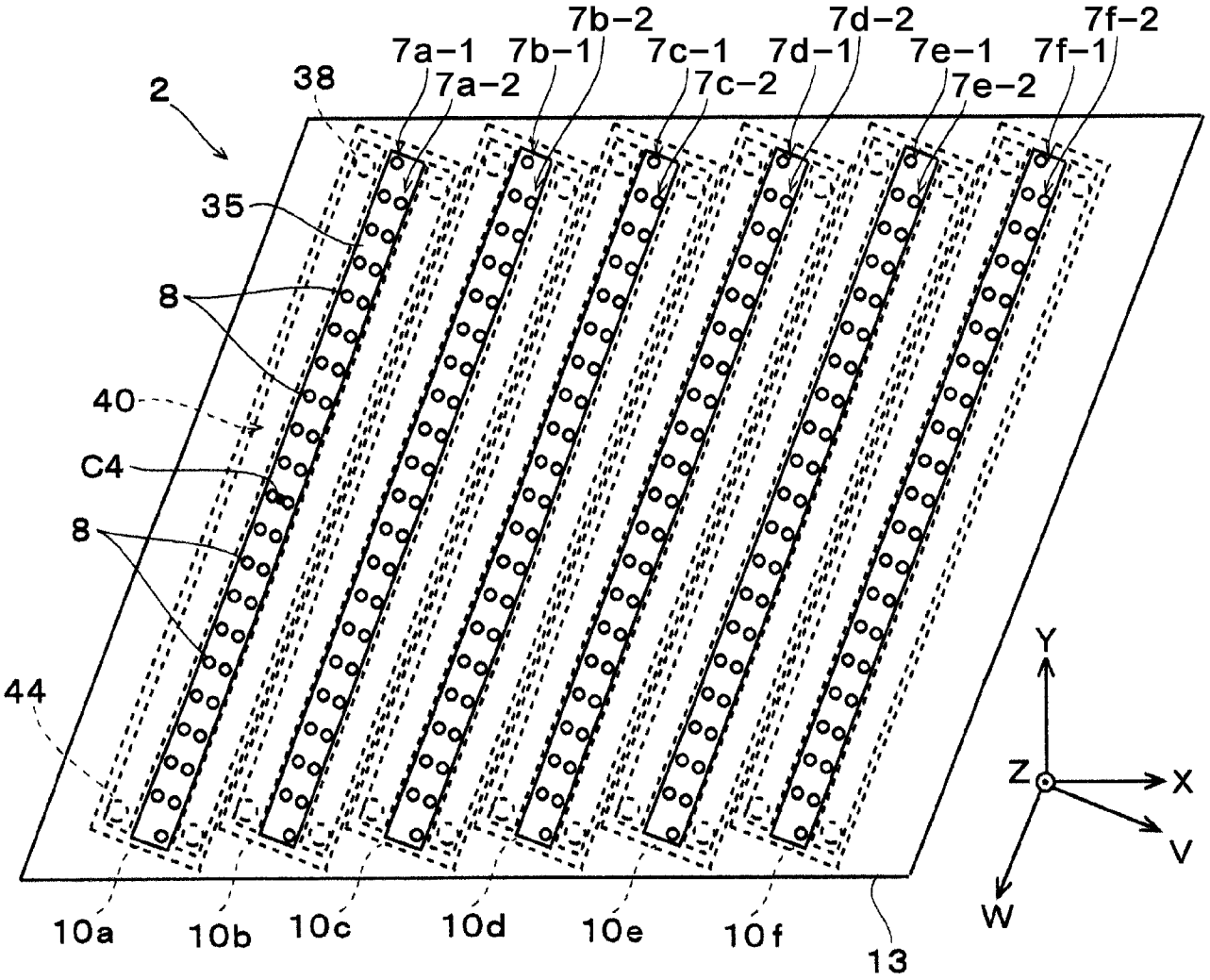
FIG. 11 is a plan view of a liquid ejecting head in a third modification example of the first embodiment when viewed from the +Z direction.
Figure 12:
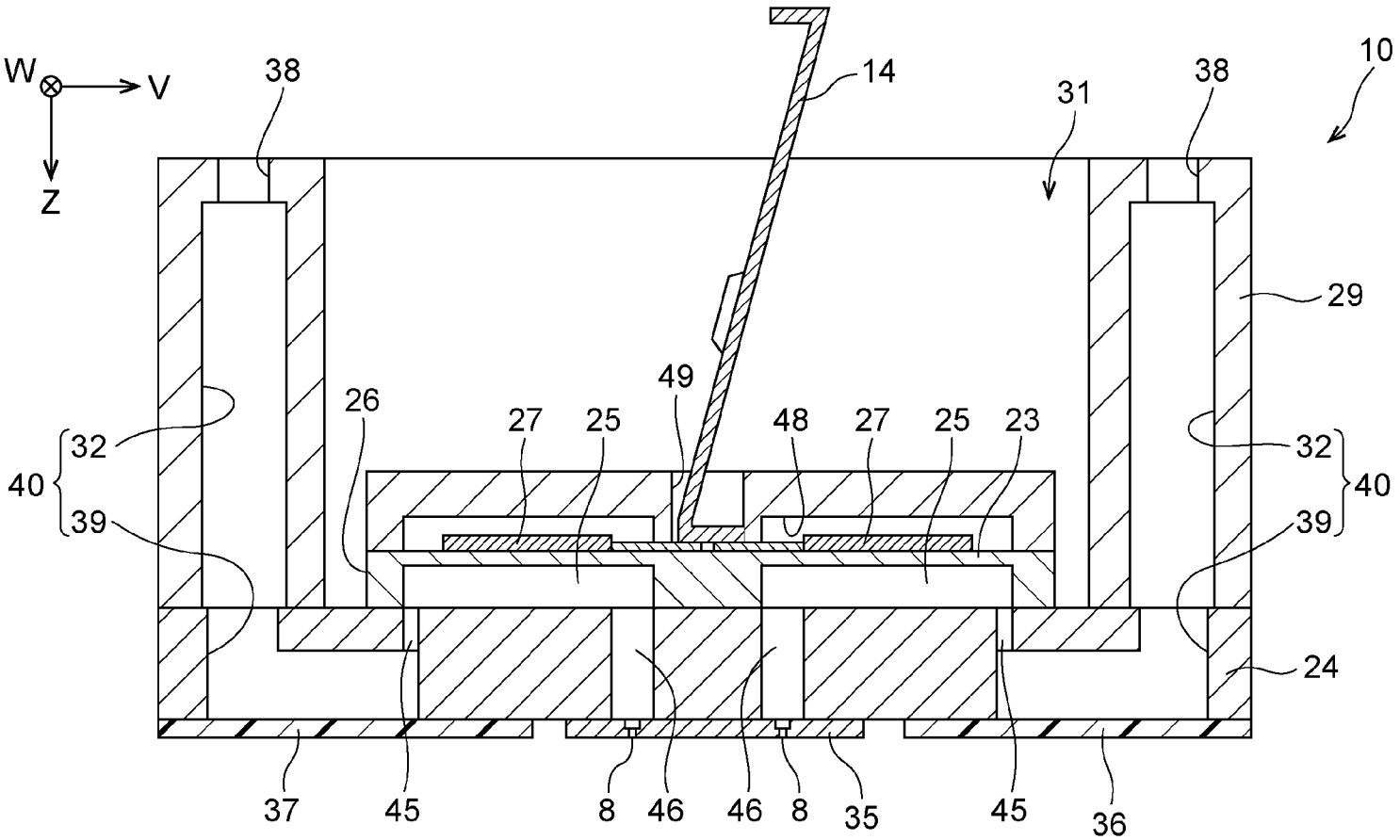
FIG. 12 is a cross-sectional view of a head unit in the third modification example of the first embodiment.
Figure 13:
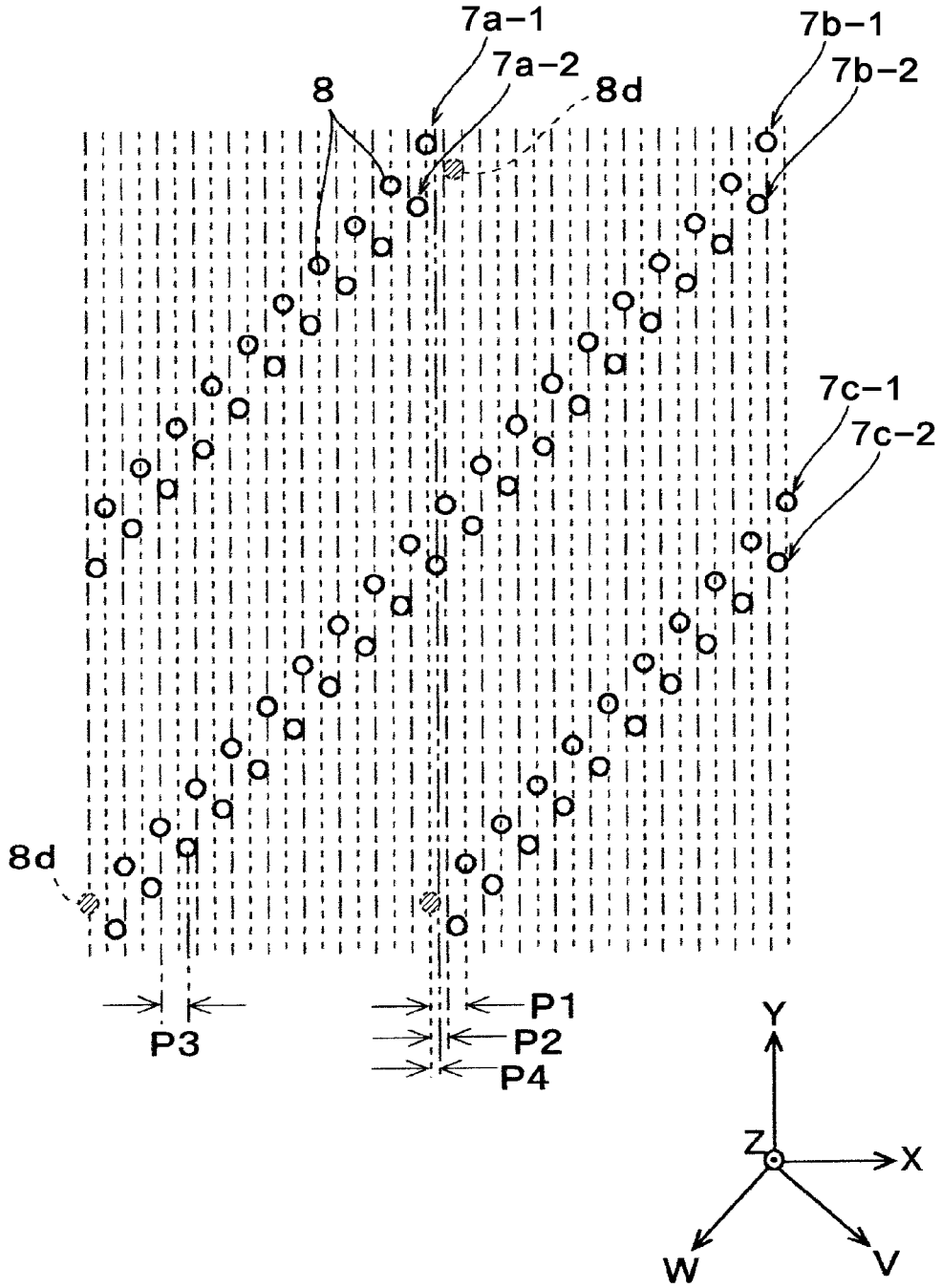
FIG. 13 is a schematic view for illustrating a positional relationship of nozzles between nozzle rows in the third modification example of the first embodiment.

FIG. 11 is a view corresponding to FIG. 7, and a plan view of the liquid ejecting head 2 according to a third modification example of the first embodiment when viewed from the +Z direction. Further, FIG. 12 is a cross-sectional view of the head unit 10 in the third modification example. Further, FIG. 13 is a schematic view for illustrating a positional relationship between the nozzles 8 of the nozzle rows 7 in the third modification example. In the liquid ejecting head 2 according to the present embodiment, a total of 6 head units 10*a* to 10*f* are arranged side by side in the X direction, and each of the head units 10*a* to 10*f* includes two nozzle rows 7. Hereinafter, among the two nozzle rows 7 provided in the same head unit 10, the nozzle row 7 located on one side (an upper left side in FIG. 11) in the V direction is referred to as a first nozzle row 7-1, and the nozzle row 7 located on the other side (a lower right side in FIG. 11) is referred to as a second nozzle row 7-2.

As illustrated in FIG. 12, in the head unit 10 in the third modification example, the introduction liquid chamber 32, the first individual communication path 45, the pressure chamber 25, and the nozzle communication path 46 are formed to correspond to the nozzle row 7. As illustrated in FIG. 11, the first nozzle row 7-1 and the second nozzle row 7-2 in the same head unit 10 are arranged side by side in the V direction to be point-symmetric to each other with respect to a center C4 of the nozzle board 35. The center C4 is located at a position corresponding to a half of a distance between, in the Y direction (that is, the transport direction of the medium M), the nozzle 8 located at one end of the first nozzle row 7-1 in the W direction and the nozzle 8 located at the other end of the second nozzle row 7-2 in the W direction, and at a position corresponding to a half of the distance in the X direction. In the present modification example, the discharge liquid chamber 43 is not provided, and the inflow port 38 and the outflow port 44 are provided in the introduction liquid chamber 32. Further, a nozzle 8*d* indicated by hatching in FIG. 13 is a dummy nozzle that is not used for ejecting the ink. Although the pressure chamber 25 corresponding to the dummy nozzle is formed, the pressure chamber 25 does not communicate with the supply liquid chamber 40, and the ink is not introduced into the pressure chamber 25. Further, the piezoelectric element 27 is not formed in a portion corresponding to the nozzle 8*d*. However, a piezoelectric body may be formed. Further, the dummy nozzle 8*d* may not actually be provided on the nozzle board 35, and only the dummy pressure chamber 25 may be formed on the pressure chamber board 26.

As illustrated in FIG. 11, the recording head 2 of the present modification example is provided with a total of 12 nozzle rows 7*a*-1, 7*a*-2, 7*b*-1, 7*b*-2, 7*c*-1, 7*c*-2, 7*d*-1, 7*d*-2, 7*e*-1, 7*e*-2, 7*f*-1, and 7*f*-2 from one end (a left end in the drawing) to the other end (a right end in the drawing) in the X direction, which eject the same type of ink (that is, ink having the same color).

As illustrated in FIG. 13, the nozzles 8 of each nozzle row 7 are arranged at the pitch P1 in the X direction. Further, in the same head unit 10, the nozzles 8 of the first nozzle row 7-1 and the nozzles 8 of the second nozzle row 7-2 adjacent to the corresponding nozzles 8 in the V direction are arranged at a pitch P3 that is three quarters of the pitch P1 in the X direction. Further, among the head units 10 adjacent to each other in the X direction, the nozzles 8 of the first nozzle row 7-1 of the one head unit 10 and the nozzles 8 of the first nozzle row 7-1 of the other head unit 10 are arranged at the pitch P2 in the X direction (the same configuration is applied to the second nozzle rows 7-2). Further, among the odd-numbered head units 10 adjacent to each other in the X direction, the nozzles 8 of the first nozzle row 7-1 of the one head unit 10 and the nozzles 8 of the first nozzle row 7-1 of the other head unit 10 are arranged at the pitch P1 in the X direction (the same configuration is applied to the second nozzle rows 7-2). Similarly, among the even-numbered head units 10 adjacent to each other in the X direction, the nozzles 8 of the first nozzle row 7-1 of the one head unit 10 and the nozzles 8 of the first nozzle row 7-1 of the other head unit 10 are arranged at the pitch P1 in the X direction (the same configuration is applied to the second nozzle rows 7-2). The other configurations such as a configuration for the circulation of the ink are the same as those in the first embodiment. In the present modification example, as illustrated in FIG. 13, in an area in which formation areas of the nozzle rows 7 overlap each other when viewed from the Y direction, the nozzle density when the nozzles 8 are arranged at a pitch P4 (for example, a pitch corresponding to 2400 dpi), which is three fourths of the pitch P1, is quadrupled as compared to a configuration in which the nozzles 8 are arranged at the pitch P1. Therefore, printing and recording can be performed with higher resolution.

In the third modification example, a configuration in which the same type (that is, the same color) of ink is ejected to all the nozzle rows 7 is described as an example. However, the present disclosure is not limited thereto, and a configuration in which different types of ink are ejected to the first nozzle row 7-1 and the second nozzle row 7-2 of the head unit 10 can be employed as a fourth modification example of the first embodiment. In this case, when viewed from the Y direction, the nozzles 8 are arranged at the pitch P2 in the X direction for each type of ink. Further, in a fifth modification example of the first embodiment, as different types of ink from the two types of ink are ejected to the odd-numbered head units 10 and the even-numbered head units 10, a total of four types of ink can be ejected. For example, black ink is ejected from the first nozzle rows 7*a*-1, 7*c*-1, and 7*e*-1 of the odd-numbered head units 10*a*, 10*c*, and 10*e*, and cyan ink is ejected from the second nozzle rows 7*a*-2, 7*c*-2, and 7*e*-2 of the odd-numbered head units 10*a*, 10*c*, and 10*e*. Further, magenta ink is ejected from the first nozzle rows 7*b*-1, 7*d*-1, and 7*f*-1 of the even-numbered head units 10*b*, 10*d*, and 10*f*, and yellow ink is ejected from the other nozzle rows 7*b*-2, 7*d*-2, and 7*f*-2 of the even-numbered head units 10*b*, 10*d*, and 10*f*. Thus, the printing can be performed using four colors of ink. That is, a printing operation is performed using three nozzle rows 7 for one type (that is, one color) of ink.

Figure 14:
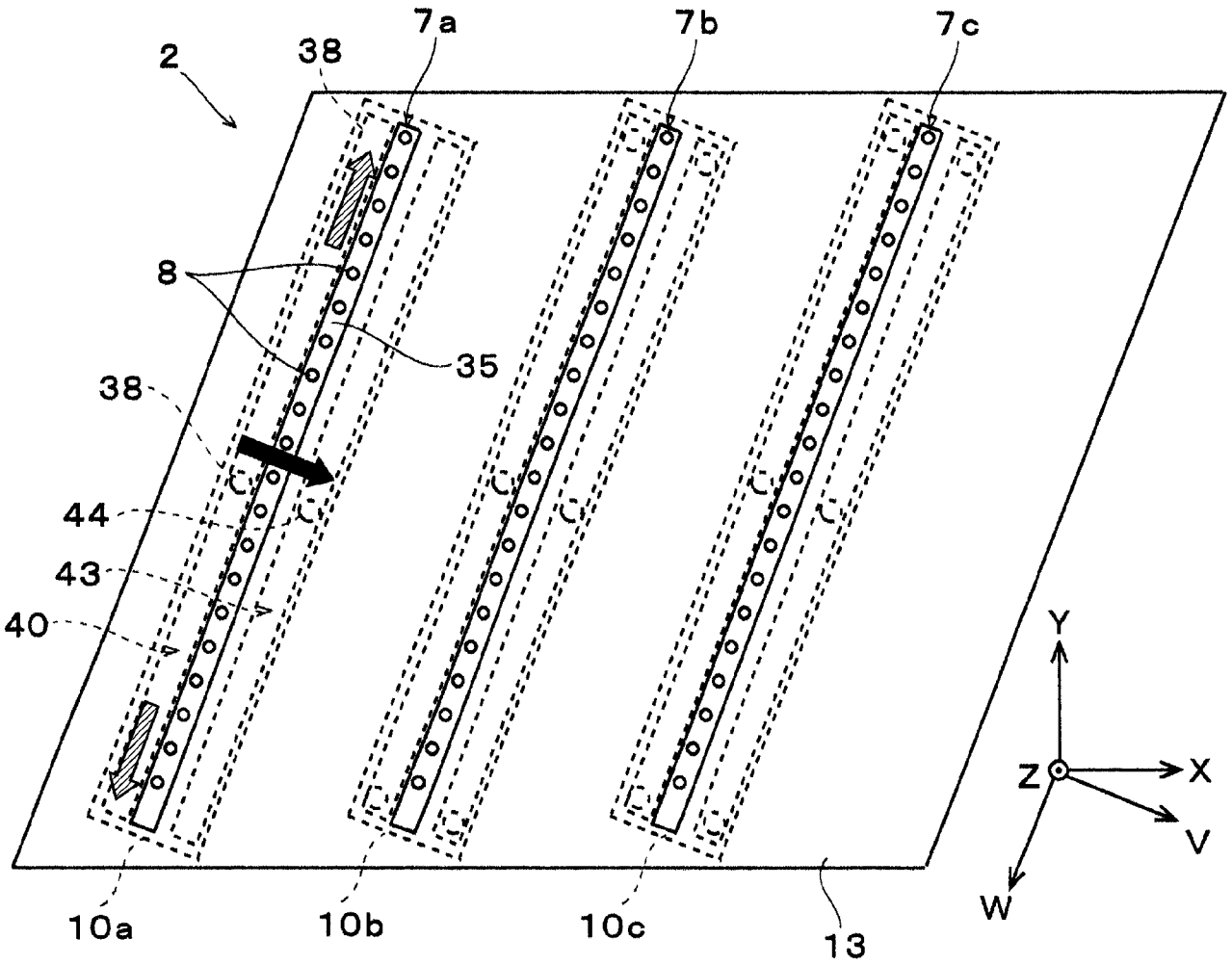
FIG. 14 is a plan view of a liquid ejecting head according to a second embodiment when viewed from the +Z direction.

FIG. 14 is a view corresponding to FIG. 7, is a plan view of the liquid ejecting head 2 according to the second embodiment when viewed from the +Z direction, and is particularly a view schematically illustrating how the ink circulates. In the present embodiment, similar to the first embodiment, in the liquid ejecting head 2, three head units 10*a* to 10*c* are arranged side by side in the X direction, and each of the head units 10*a* to 10*c* includes one nozzle row 7. The nozzle rows 7*a* to 7*c* of the head unit 10 eject the same type of ink, that is, the same color ink. A positional relationship between the nozzles 8 of the nozzle rows 7 is the same as that in the first embodiment illustrated in FIG. 8. Further, as illustrated in FIG. 6, the head unit 10 has the supply liquid chamber 40 and the discharge liquid chamber 43, the supply liquid chamber 40 is provided with the inflow port 38, and the discharge liquid chamber 43 is provided with the outflow port 44. In an example of FIG. 14, the inflow port 38 is provided at a central portion of the supply liquid chamber 40 in the W direction, and the outflow port 44 is provided at a central portion of the discharge liquid chamber 43 in the W direction. The positions of the inflow port 38 and the outflow port 44 in the supply liquid chamber 40 are not limited to the illustrated configurations. For example, a configuration can be employed in which the inflow port 38 is provided at one end of the supply liquid chamber 40 in the W direction, and the outflow port 44 is provided at the other end of the discharge liquid chamber 43 in the W direction. Accordingly, since the ink flows from one end to the other end of the supply liquid chamber 40 and the discharge liquid chamber 43, retention of the ink is suppressed, and as a result, bubble discharge performance is improved.

In the present embodiment, when the ink circulates by driving the pump 6, if the ink is introduced from the inflow port 38 to the supply liquid chamber 40, the ink in the supply liquid chamber 40 flows along the W direction as indicated by a hatching arrow and is supplied to the pressure chamber 25 through the first individual communication path 45. Further, the ink, which has not been ejected from the nozzle 8, flows into the discharge liquid chamber 43 through the second individual communication path 47 as indicated by a black arrow. That is, the ink flows from the supply liquid chamber 40 into the discharge liquid chamber 43 through the pressure chamber 25. The ink, which has flowed into the discharge liquid chamber 43, is sent out from the outflow port 44 and returns to the liquid storage member 3. While the pump 6 is driven, the ink continuously circulates between the inflow port 38 and the outflow port 44. The other configurations are the same as those of the first embodiment illustrated in FIG. 8.

The ink can circulate even in the configuration of the present embodiment. Thus, even when bubbles are generated inside the head unit 10, the bubbles can be discharged to the outside of the head unit 10. As a result, the number of times of so-called maintenance operations, such as a cleaning operation and a flushing operation, for forcibly discharging the ink inside the head unit 10 from the nozzle 8 can be reduced, and the amount of the ink consumed in the maintenance operation can be reduced. Further, since the ink circulates through the individual flow path, which is a flow path provided in each nozzle 8, such as the pressure chamber 25, it is possible to suppress the thickening of the ink near the nozzles 8 and the sedimentation of contained components in the ink. Accordingly, the number of times of maintenance operations can be further reduced. Further, since the ink circulates through the individual flow path such as the pressure chamber 25, it is possible to suppress the thickening of the ink near the nozzles 8 and the sedimentation of the contained components in the ink. Accordingly, the number of times of maintenance operations can be further reduced.

Figure 15:
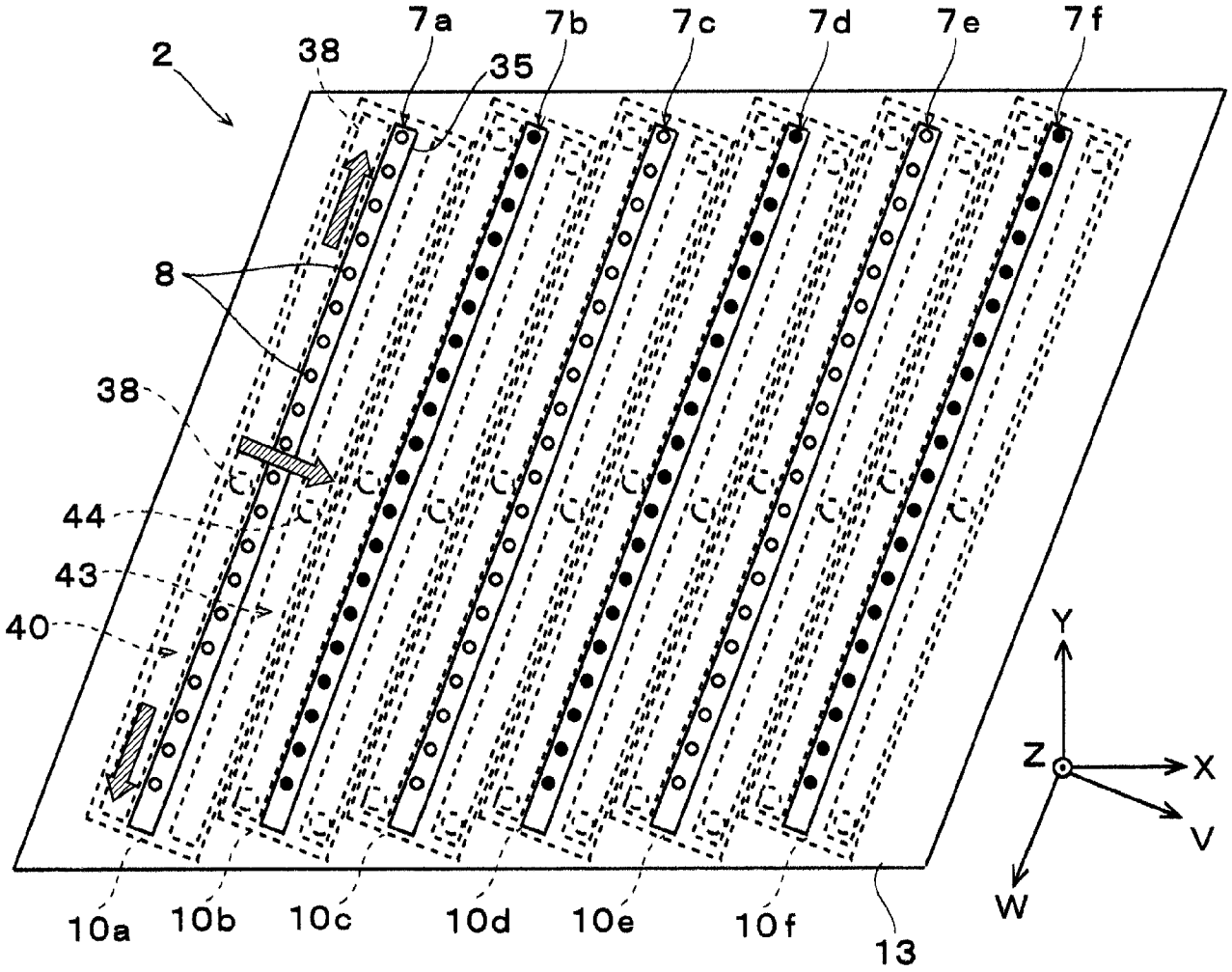
FIG. 15 is a plan view of a liquid ejecting head according to a first modification example of the second embodiment when viewed from the +Z direction.

FIG. 15 is a view corresponding to FIG. 7, and a plan view of the liquid ejecting head 2 according to a first modification example of the second embodiment when viewed from the +Z direction. In the liquid ejecting head 2 according to the present embodiment, a total of 6 head units 10*a* to 10*f* are arranged side by side in the X direction, and each of the head units 10*a* to 10*f* includes one nozzle row 7. In detail, nozzle rows 7*a* to 7*f* are provided from one end (a left end in the drawing) toward the other end (a right end in the drawing) in the X direction. Among them, the odd-numbered nozzle rows 7*a*, 7*c*, and 7*e* in which the nozzles 8 are indicated by white circles in FIG. 15, and the even-numbered nozzle rows 7*b*, 7*d*, and 7*f* in which the nozzles 8 are indicated by black circles in the same drawing eject different types of ink. That is, in the present embodiment, the liquid ejecting head 2 is configured to eject two types of ink. A positional relationship between the nozzles 8 in each nozzle row 7 is the same as that of the first modification example of the first embodiment illustrated in FIGS. 9 and 10. Further, the other configurations such as a configuration for the circulation of the ink are the same as those in the second embodiment.

In the first modification example, a configuration is exemplified in which the odd-numbered nozzle rows 7*a*, 7*c*, and 7*e* and the even-numbered nozzles 7*b*, 7*d*, and 7*f* in which the nozzles 8 are indicated by black circles in the same drawing eject different types of ink. However, the present disclosure is not limited to this configuration, and a configuration in which the same type of ink is ejected to the nozzle rows 7*a* to 7*f* can be employed as a second modification example of the second embodiment. In this case, in an area in which formation areas of the nozzle rows 7 overlap each other when viewed from the Y direction, the nozzle density in the X direction when the nozzles 8 are arranged at the pitch P2 in the X direction (for example, a pitch corresponding to 1200 dpi) is doubled as compared to a configuration in which the nozzles 8 are arranged at the pitch P1. Therefore, printing and recording can be performed with higher resolution.

Figure 16:
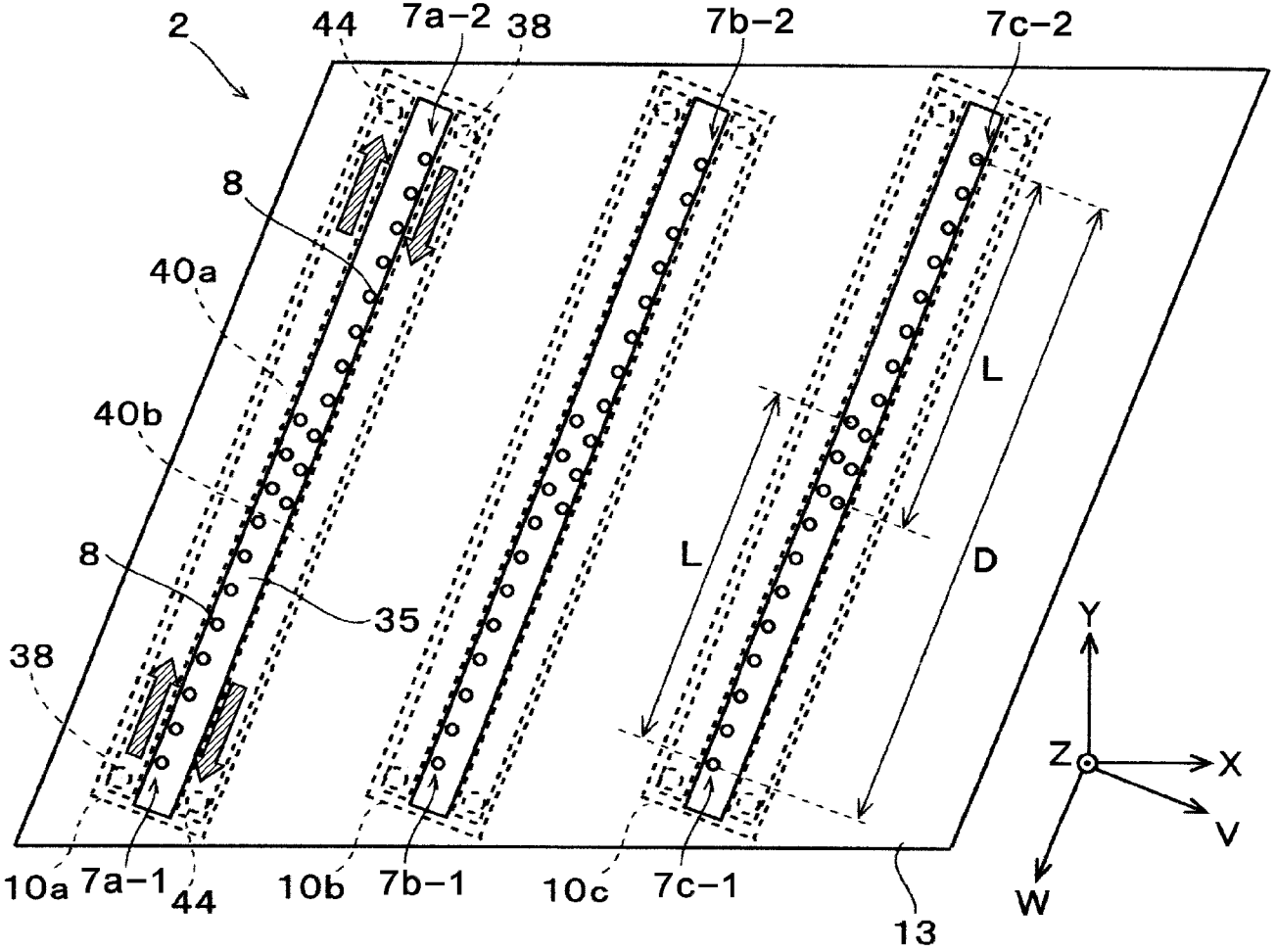
FIG. 16 is a plan view of a liquid ejecting head according to a third embodiment when viewed from the +Z direction.
Figure 17:
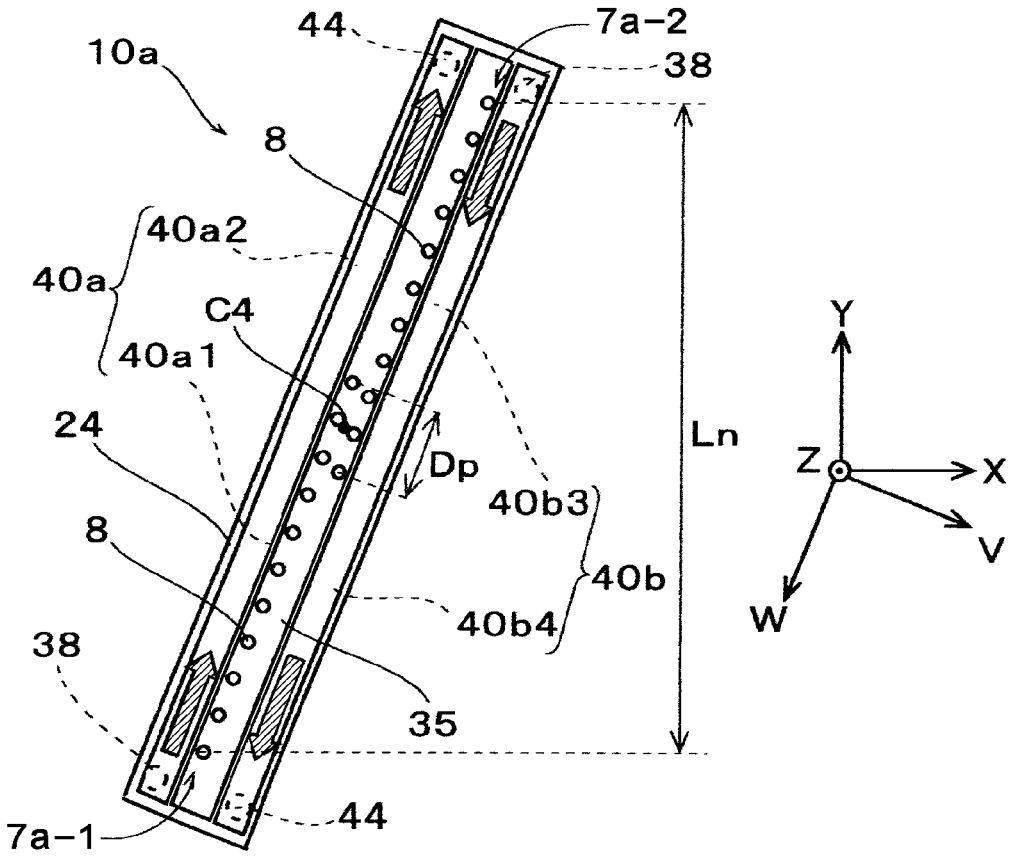
FIG. 17 is a plan view of the head unit when viewed from the +Z direction.

FIG. 16 is a view corresponding to FIG. 7, is a plan view of the liquid ejecting head 2 according to a third embodiment when viewed from the +Z direction, and is particularly a view schematically illustrating how the ink circulates. Further, FIG. 17 is a plan view of the head unit 10*a* when viewed from the +Z direction. In FIG. 17, only the head unit 10*a* is illustrated as a representative, but the other head units 10 also have the same configuration. Further, in FIG. 17, illustration of the first compliance board 36 and the second compliance board 37 illustrated in FIG. 12 is omitted.

In the present embodiment, similar to the first embodiment, in the liquid ejecting head 2, three head units 10*a* to 10*c* are arranged side by side in the X direction, and each of the head units 10*a* to 10*c* includes two nozzle rows 7. The head unit 10*a* includes a first nozzle row 7*a*-1 disposed on one side (a −V direction side) in the V direction and a second nozzle row 7*a*-2 disposed on the other side (a +V direction side) in the V direction. Similarly, a head unit 10*b* includes a first nozzle row 7*b*-1 and a second nozzle row 7*b*-2, and a head unit 10*c* includes a first nozzle row 7*c*-1 and a second nozzle row 7*c*-2. The length L of the first nozzle row 7-1 and the second nozzle row 7-2 and a distance D from the nozzle 8 located at one end of the head unit 10 in the W direction (in an example of FIG. 16, the nozzle 8 located at one end of the second nozzle row 7-2) to the nozzle 8 located at the other end in the W direction (in an example of FIG. 16, the nozzle 8 located at the other end of the first nozzle row 7-1) are set to $D/2<L<D$. Further, as illustrated in FIG. 17, the first nozzle row 7-1 and the second nozzle row 7-2 in the head unit 10 are arranged side by side in the V direction to be point-symmetric to each other with respect to the center C4 of the nozzle board 35.

As illustrated in FIG. 17, when the head unit 10*a* is described as a representative of the head units 10*a* to 10*c*, the first nozzle row 7*a*-1 and the second nozzle row 7*a*-2 are arranged such that the formation areas of some of the nozzles 8 overlap each other. That is, in the W direction when viewed from the V direction, in an area Dp from the nozzle 8 located at one end of the first nozzle row 7*a*-1 in the W direction to the nozzle 8 located at the other end of the second nozzle row 7*a*-2 in the W direction, the formation areas of the nozzles 8 of the nozzle rows 7*a*-1 and 7*a*-2 overlap each other. In the area Dp, the positions of some of the nozzles 8 of the first nozzle row 7*a*-1 and some of the nozzles 8 of the second nozzle row 7*a*-2 in the X direction overlap each other when viewed in the Y direction. That is, in the head unit 10 having the configuration, the nozzles 8 of the first nozzle rows 7*a*-1 and the nozzles 8 of the second nozzle row 7*a*-2 are continuously arranged at the pitch P1 in the X direction when viewed from the Y direction. Therefore, the nozzles 8 can be continued in the X direction at the constant pitch P1 as a whole of the liquid ejecting head 2. Accordingly, dots can be continuously formed on the medium M at the constant pitch P1 in the X direction using the first nozzle row 7-1 and the second nozzle row 7-2 of the head unit 10. In the area Dp, the positions of the nozzles 8 of the first nozzle row 7*a*-1 and the nozzles 8 of the second nozzle row 7*a*-2 in the W direction are not necessarily matched with each other when viewed from the V direction. Further, among the nozzles 8 of which the positions overlap each other in the X direction, one nozzle 8 may be used for ejecting the ink, and the other nozzle 8 may not be used for ejecting the ink.

In the present embodiment, the head unit 10 is provided with two supply liquid chambers 40 corresponding to the first nozzle row 7-1 and the second nozzle row 7-2, respectively. That is, as illustrated in FIG. 17, the head unit 10*a* is provided with a first supply liquid chamber 40*a* communicating with the pressure chamber 25 corresponding to the first nozzle row 7*a*-1 and a second supply liquid chamber 40*b* communicating with the pressure chamber 25 corresponding to the second nozzle row 7*a*-2. The total length of the supply liquid chambers 40*a* and 40*b* in the W direction is set to be equal to or larger than D. That is, each of the supply liquid chambers 40*a* and 40*b* is a flow path that is longer than the length L of the corresponding nozzle row 7 in the W direction. The first supply liquid chamber 40*a* includes a first portion 40*a*1 that extends in the W direction in parallel to the first nozzle row 7*a*-1, and a second portion 40*a*2 that extends in the W direction toward one end of the second nozzle row 7*a*-2 beyond one end of the first nozzle row 7*a*-1 (an upper right end in FIG. 17) while being continuous with respect to the first portion 40*a*1. Similarly, the second supply liquid chamber 40*b* includes a third portion 40*b*3 that extends in the W direction in parallel to the second nozzle row 7*a*-2, and a fourth portion 40*b*4 that extends in the W direction toward the other end of the first nozzle row 7*a*-1 beyond the other end of the second nozzle row 7*a*-2 (a lower left end in FIG. 17) while being continuous with respect to the third portion 40*b*3. The first supply liquid chamber 40*a* and the second supply liquid chamber 40*b* are provided with the inflow port 38 and the outflow port 44, respectively. In the present embodiment, the inflow port 38 is provided at the other end portion of the first supply liquid chamber 40*a* in the W direction, and the outflow port 44 is provided at one end portion of the first supply liquid chamber 40*a*. Similarly, the inflow port 38 is provided at one end portion of the second supply liquid chamber 40*b* in the W direction, and the outflow port 44 is provided at the other end portion of the second supply liquid chamber 40*b*. That is, similar to the first nozzle row 7*a*-1 and the second nozzle row 7*a*-2, the first supply liquid chamber 40*a* and the second supply liquid chamber 40*b* are arranged side by side in the V direction to be point-symmetric to each other with respect to the center C4 of the nozzle board 35. The positions of the inflow port 38 and the outflow port 44 in the supply liquid chamber 40 are not limited to the illustrated configuration. For example, a positional relationship between the inflow port 38 and the outflow port 44 may be opposite to that illustrated in FIG. 17.

In the present embodiment, when the ink circulates, if the ink sent from the liquid storage member 3 is introduced from the inflow port 38 to the supply liquid chambers 40*a* and 40*b*, as indicated by hatching arrows in FIGS. 16 and 17, the ink flows in the first portion 40*a*1 and the third portion 40*b*3 in the W direction, and is supplied to the pressure chamber 25 through the first individual communication path 45. The ink that is not ejected from the nozzles 8 (in other words, the ink that is not supplied to the pressure chamber 25 through the first individual communication path 45) flows in the second portion 40*a*2 and the fourth portion 40*b*4, is sent out from the outflow port 44 provided at an end portion, and returns to the liquid storage member 3. In this way, while the pump 6 is driven, the circulation of the ink in the supply liquid chamber 40 continues between the inflow port 38 and the outflow port 44. Even in a configuration of the present embodiment, when bubbles are generated inside the head unit 10, the bubbles can be discharged to the outside of the head unit 10. As a result, the amount of the ink consumed for the maintenance operation can be reduced. Further, in the present embodiment, as compared to a configuration of the fourth embodiment, which will be described below (however, when the lengths of the first nozzle row and the second nozzle row are the same in the present embodiment and the fourth embodiment), as illustrated in FIG. 17, an area Ln in which the first nozzle row and the second nozzle row are arranged in the Y direction that is the transport direction of the medium M (that is, a distance, in the Y direction, from the nozzle 8 located at one end of the second nozzle row in the W direction to the nozzle 8 located at the other end of the first nozzle row 7*a*-1 in the W direction) can be shortened. Therefore, a landing position deviation of the ink in the Y direction with respect to the medium M can be suppressed during the printing operation. Even in the present embodiment, similar to the first modification example of the first embodiment, as the number of the used head units 10 increases, the formation density of the nozzles 8 can increase, two types of ink can be ejected, and the formation density of the nozzles 8 can increase in a configuration in which one type of ink is ejected.

Figure 18:
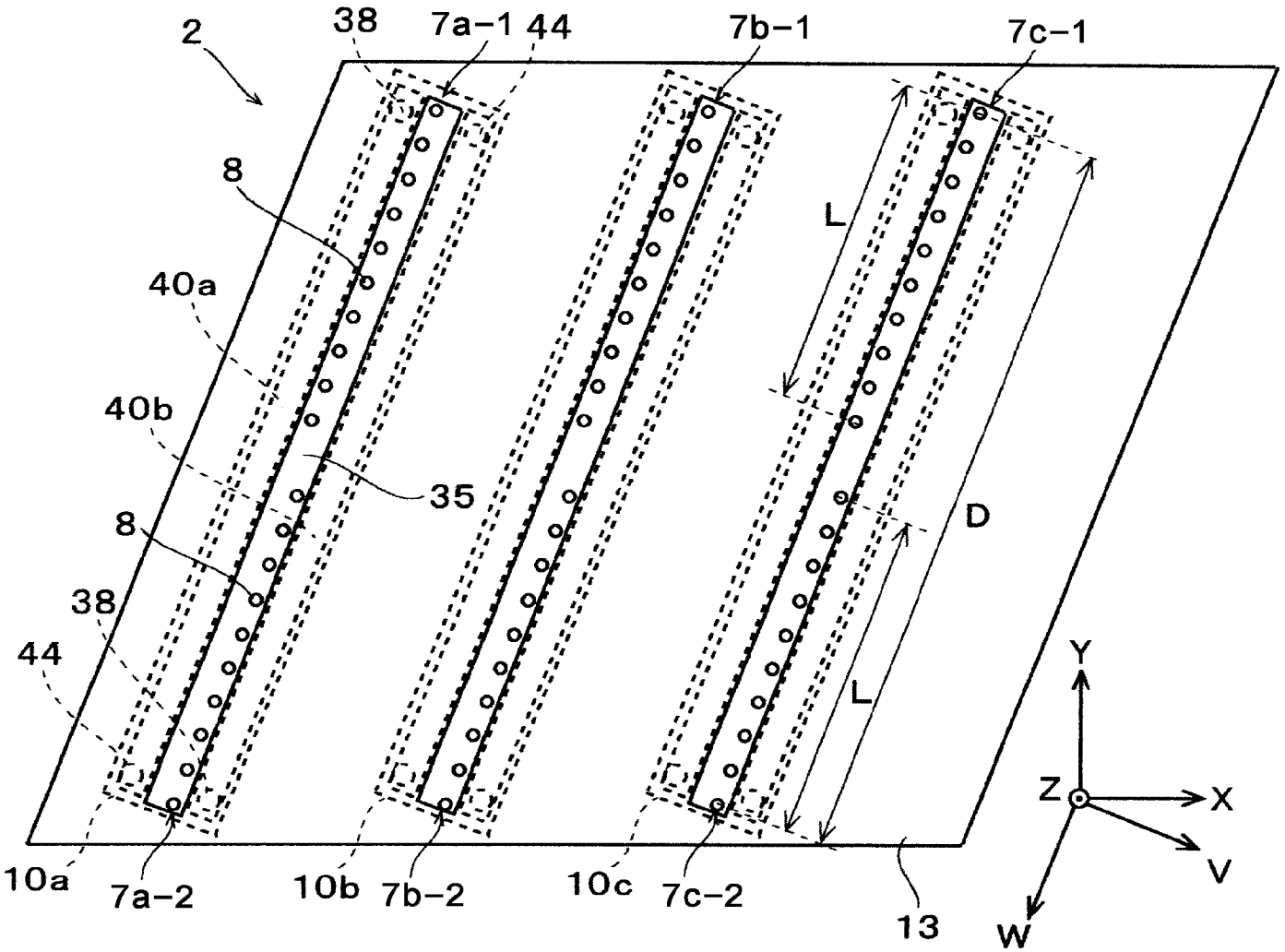
FIG. 18 is a plan view of a liquid ejecting head according to a fourth embodiment when viewed from the +Z direction.
Figure 19:
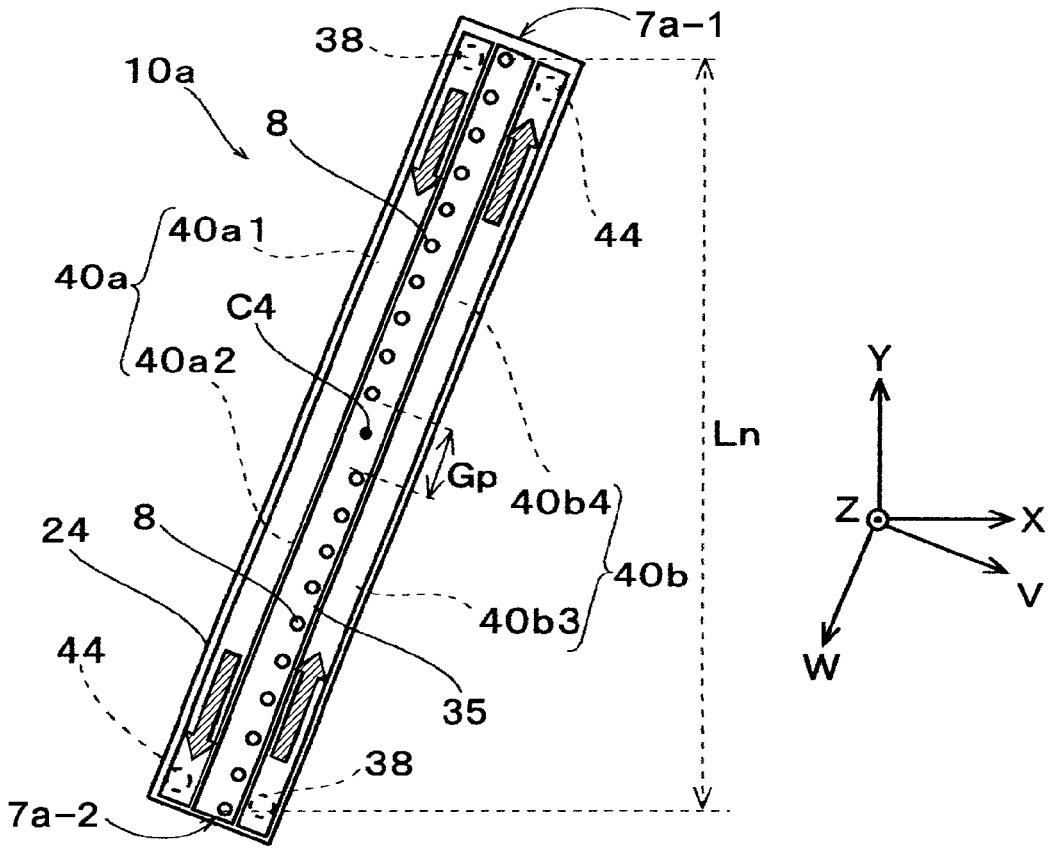
FIG. 19 is a plan view of the head unit when viewed from the +Z direction.

FIG. 18 is a view corresponding to FIG. 7, is a plan view of the liquid ejecting head 2 according to a fourth embodiment when viewed from the +Z direction, and is particularly a view schematically illustrating how the ink circulates. Further, FIG. 19 is a view corresponding to FIG. 17, and is a plan view when the head unit 10*a* is viewed from the +Z direction. In FIG. 19, only the head unit 10*a* is illustrated as a representative, but the other head units 10 also have the same configuration.

In the present embodiment, in the liquid ejecting head 2, three head units 10*a* to 10*c* are arranged side by side in the X direction, and each of the head units 10*a* to 10*c* includes the first nozzle row 7-1 and the second nozzle row 7-2. In detail, as illustrated in FIG. 19, the head unit 10*a* includes a first nozzle row 7*a*-1 disposed on one side (a −V direction side) in the V direction and a second nozzle row 7*a*-2 disposed on the other side (a +V direction side) in the V direction. Similarly, a head unit 10*b* includes a first nozzle row 7*b*-1 and a second nozzle row 7*b*-2, and a head unit 10*c* includes a first nozzle row 7*c*-1 and a second nozzle row 7*c*-2.

As illustrated in FIG. 18, the length L of the first nozzle row 7-1 and the second nozzle row 7-2 and a distance D from the nozzle 8 located at one end of the head unit 10 in the W direction (that is, the nozzle 8 located at the one end of the first nozzle row 7-1) to the nozzle 8 located at the other end in the W direction (that is, the nozzle 8 located at the other end of the second nozzle row 7-2) are set to $L<D/2$. Further, the first nozzle row 7-1 and the second nozzle row 7-2 in the head unit 10 are arranged side by side in the V direction to be point-symmetric to each other with respect to the center C4 of the nozzle board 35.

As illustrated in FIG. 19, when the head unit 10*a* is described as a representative of the head units 10*a* to 10*c*, the first nozzle row 7*a*-1 and the second nozzle row 7*a*-2 are arranged such that the formation areas of the nozzles 8 do not overlap each other when viewed from the V direction. That is, an area Gp where the nozzles 8 are not formed in the W direction (where the length of the area Gp in the W direction is longer than the pitch of the nozzles 8 of the nozzle row 7 in the W direction) is formed between the nozzle 8 located at the other end of the first nozzle row 7*a*-1 in the W direction and the nozzle 8 located at the one end of the second nozzle row 7*a*-2 in the W direction. Further, an interval from the nozzle 8 located at the other end of the first nozzle row 7-1 to the nozzle 8 located at the one end of the second nozzle row 7-2 in the X direction is the pitch P1. In this configuration, the nozzles 8 of the first nozzle row 7*a*-1 and the nozzles 8 of the second nozzle row 7*a*-2 are continuously arranged at the pitch P1 in the X direction when viewed from the Y direction. Therefore, the nozzles 8 can be continued in the X direction at the constant pitch P1 as a whole of the liquid ejecting head 2. In the area Gp, when the first nozzle row 7*a*-1 and the second nozzle row 7*a*-2 virtually extend in the W direction, the pressure chamber 25 (that is, the dummy pressure chamber) into which the ink is not introduced may be formed to correspond to the positions where the nozzles 8 are formed at the pitch P1. The piezoelectric element 27 may or may not be formed in a portion corresponding to the dummy pressure chamber.

In the present embodiment, the head unit 10 is provided with two supply liquid chambers 40 corresponding to the first nozzle row 7-1 and the second nozzle row 7-2, respectively. That is, as illustrated in FIG. 19, the head unit 10*a* is provided with a first supply liquid chamber 40*a* communicating with the pressure chamber 25 corresponding to the first nozzle row 7*a*-1 and a second supply liquid chamber 40*b* communicating with the pressure chamber 25 corresponding to the second nozzle row 7*a*-2. The entire length of the supply liquid chambers 40*a* and 40*b* in the W direction is longer than the length L of the nozzle rows 7 in the W direction. The first supply liquid chamber 40*a* includes a first portion 40*a*1 that extends in the W direction in parallel to the first nozzle row 7*a*-1, and a second portion 40*a*2 that extends in the W direction toward the other end of the second nozzle row 7*a*-2 beyond the other end of the first nozzle row 7*a*-1 (a lower left end in FIG. 19) while being continuous with respect to the first portion 40*a*1. Similarly, the second supply liquid chamber 40*b* includes a third portion 40*b*3 that extends in the W direction in parallel to the second nozzle row 7*a*-2, and a fourth portion 40*b*4 that extends in the W direction toward the one end of the first nozzle row 7*a*-1 beyond the one end of the second nozzle row 7*a*-2 (an upper right end in FIG. 19) while being continuous with respect to the third portion 40*b*3. The first supply liquid chamber 40*a* and the second supply liquid chamber 40*b* are provided with the inflow port 38 and the outflow port 44, respectively. In the present embodiment, the inflow port 38 is provided at the one end portion of the first supply liquid chamber 40*a* in the W direction, and the outflow port 44 is provided at the other end portion of the first supply liquid chamber 40*a*. Similarly, the inflow port 38 is provided at the other end portion of the second supply liquid chamber 40*b* in the W direction, and the outflow port 44 is provided at the one end portion of the second supply liquid chamber 40*b*. That is, similar to the first nozzle row 7*a*-1 and the second nozzle row 7*a*-2, the first supply liquid chamber 40*a* and the second supply liquid chamber 40*b* are arranged side by side in the V direction to be point-symmetric to each other with respect to the center C4 of the nozzle board 35. The positions of the inflow port 38 and the outflow port 44 in the supply liquid chamber 40 are not limited to the illustrated configuration. For example, a positional relationship between the inflow port 38 and the outflow port 44 may be opposite to that illustrated in FIG. 19.

In the present embodiment, when the ink circulates, if the ink sent from the liquid storage member 3 is introduced from the inflow port 38 to the supply liquid chambers 40*a* and 40*b*, as indicated by hatching arrows in FIGS. 18 and 19, the ink flows in the first portion 40*a*1 and the third portion 40*b*3 in the W direction, and is supplied to the pressure chamber 25 through the first individual communication path 45. The ink that is not ejected from the nozzles 8 (in other words, the ink that is not supplied to the pressure chamber 25 through the first individual communication path 45) flows in the second portion 40*a*2 and the fourth portion 40*b*4, is sent out from the outflow port 44 provided at an end portion, and returns to the liquid storage member 3. In this way, while the pump 6 is driven, the circulation of the ink in the supply liquid chamber 40 continues between the inflow port 38 and the outflow port 44. Even in a configuration of the present embodiment, when bubbles are generated in a flow path inside the head unit 10, the bubbles can be discharged to the outside of the head unit 10. As a result, the amount of the ink consumed for the maintenance operation can be reduced.

Similar to the first modification example of the first embodiment, as the number of the used head units 10 increases, the formation density of the nozzles 8 can increase, two types of ink can be ejected, and the formation density of the nozzles 8 can increase in a configuration in which one type of ink is ejected.

Figure 20:
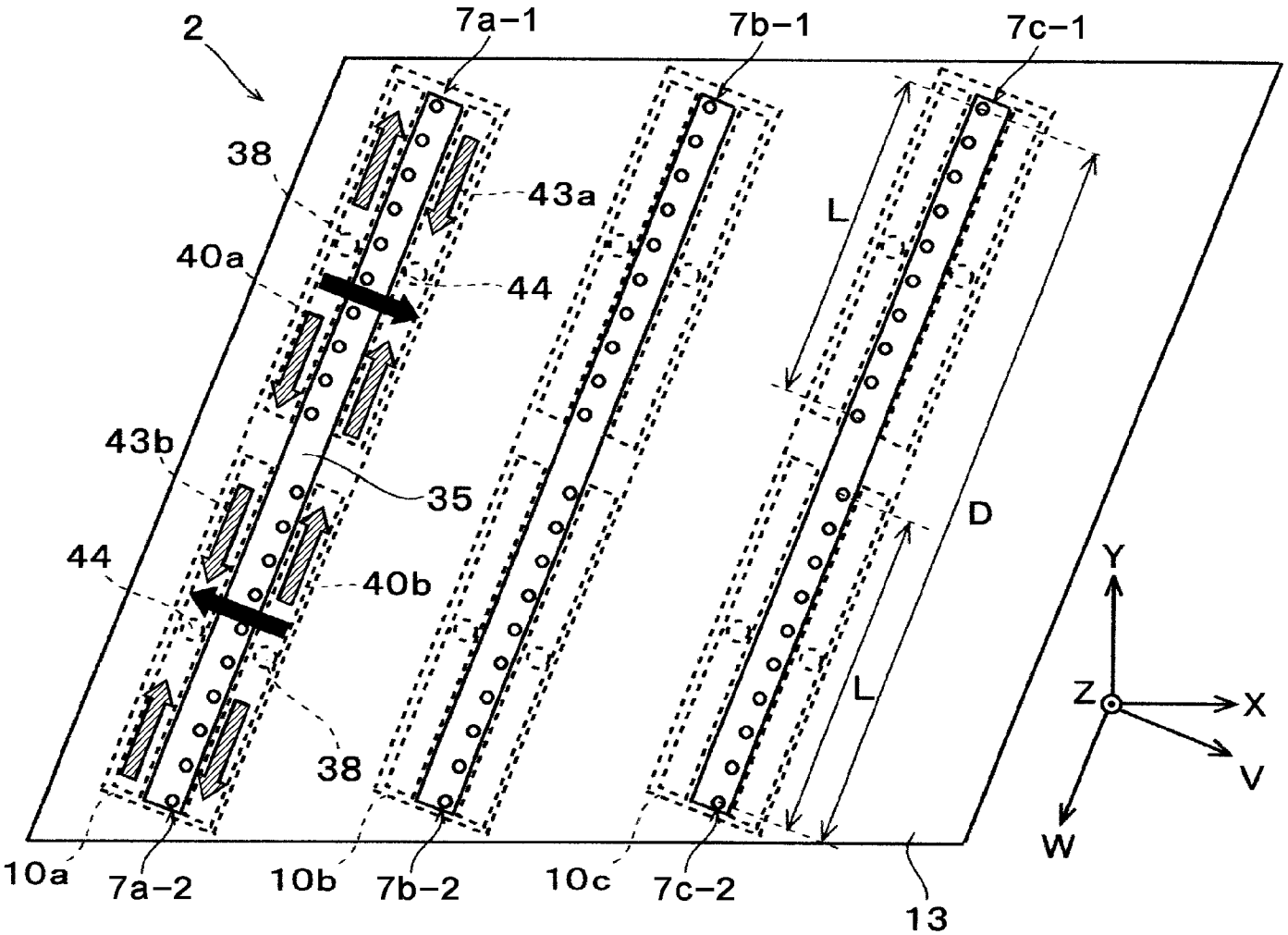
FIG. 20 is a plan view of a liquid ejecting head according to a fifth embodiment when viewed from the +Z direction.
Figure 21:
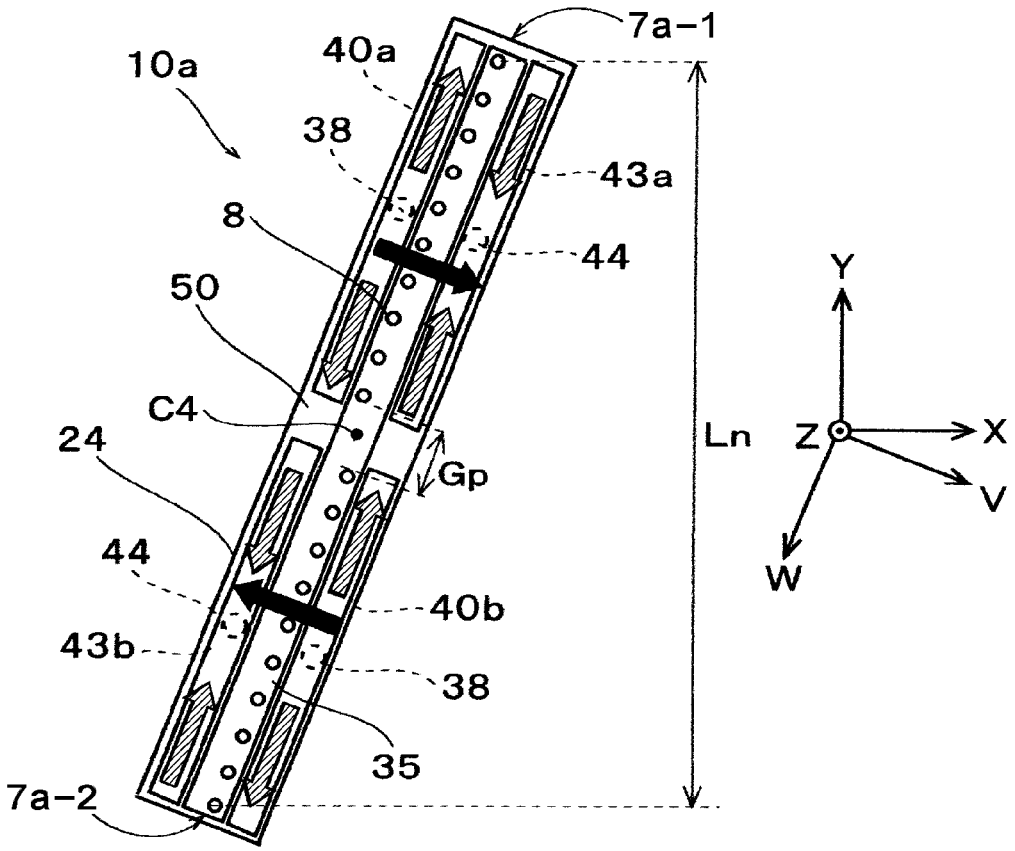
FIG. 21 is a plan view of the head unit when viewed from the +Z direction.

FIG. 20 is a view corresponding to FIG. 7, is a plan view of the liquid ejecting head 2 according to a fifth embodiment when viewed from the +Z direction, and is particularly a view schematically illustrating how the ink circulates. Further, FIG. 21 is a view corresponding to FIG. 17, and is a plan view when the head unit 10*a* is viewed from the +Z direction. In FIG. 21, only the head unit 10*a* is illustrated as a representative, but the other head units 10 also have the same configuration. In the present embodiment, in the liquid ejecting head 2, three head units 10*a* to 10*c* are arranged side by side in the X direction, and each of the head units 10*a* to 10*c* includes two nozzle rows 7. In detail, as illustrated in FIG. 21, the head unit 10*a* includes a first nozzle row 7*a*-1 disposed on one side (a −V direction side) in the V direction and a second nozzle row 7*a*-2 disposed on the other side (a +V direction side) in the V direction. Similarly, a head unit 10*b* includes a first nozzle row 7*b*-1 and a second nozzle row 7*b*-2, and a head unit 10*c* includes a first nozzle row 7*c*-1 and a second nozzle row 7*c*-2. The arrangement and the length of the nozzle row 7 are the same as those in the fourth embodiment. That is, as illustrated in FIG. 21, the first nozzle row 7*a*-1 and the second nozzle row 7*a*-2 are arranged such that the formation areas of the nozzles 8 do not overlap each other when viewed from the V direction, and the area Gp in which the nozzles 8 are not formed in the W direction is formed between the first nozzle row 7*a*-1 and the second nozzle row 7*a*-2. In this configuration, the nozzles 8 of the first nozzle row 7*a*-1 and the nozzles 8 of the second nozzle row 7*a*-2 are continuously arranged at the pitch P1 in the X direction when viewed from the Y direction. Therefore, the nozzles 8 as a whole of the liquid ejecting head 2 are continuous at the constant pitch P1 in the X direction.

In the present embodiment, in the head unit 10, the first nozzle row 7-1 and the second nozzle row 7-2 are provided with the supply liquid chamber 40 and the discharge liquid chamber 43. That is, as illustrated in FIG. 21, in the head unit 10*a*, the head unit 10*a* is provided with a first supply liquid chamber 40*a* that is pinched between the first nozzle rows 7*a*-1 in the V direction and is disposed on one side (an upper left side in FIG. 21) of the first nozzle row 7*a*-1 and a first discharge liquid chamber 43*a* disposed on the other side (a lower right side in FIG. 21) of the first nozzle row 7*a*-1. Further, the head unit 10*a* is provided with a second discharge liquid chamber 43*b* that is pinched between the second nozzle rows 7*a*-2 in the V direction and is disposed on one side of the second nozzle row 7*a*-2 and a second supply liquid chamber 40*b* disposed on the other side of the second nozzle row 7*a*-2. The first supply liquid chamber 40*a* of the first nozzle row 7*a*-1 and the second discharge liquid chamber 43*b* of the second nozzle row 7*a*-2, which are adjacent to each other in the W direction, are separated from each other by a partition wall 50 and do not communicate with each other. Similarly, the first discharge liquid chamber 43*a* of the first nozzle row 7*a*-1 and the second supply liquid chamber 40*b* of the second nozzle row 7*a*-2, which are adjacent to each other in the W direction, are separated from each other by the partition wall 50, and do not communicate with each other. A positional relationship between the supply liquid chamber 40 and the discharge liquid chamber 43 in the nozzle row 7 is not limited to that illustrated and can be set in a predetermined manner. For example, the positional relationship can be opposite to the illustrated positional relationship.

Each of the first supply liquid chamber 40*a* and the second supply liquid chamber 40*b* is provided with the inflow port 38. Further, each of the first discharge liquid chamber 43*a* and the second discharge liquid chamber 43*b* is provided with the outflow port 44. In the present embodiment, a central portion of each of the first supply liquid chamber 40*a* and the second supply liquid chamber 40*b* in the W direction is provided with the inflow port 38, and a central portion of each of the first discharge liquid chamber 43*a* and the second discharge liquid chamber 43*b* in the W direction is provided with the outflow port 44. That is, similar to the first nozzle row 7*a*-1 and the second nozzle row 7*a*-2, the first supply liquid chamber 40*a* and the second supply liquid chamber 40*b* are arranged to be point-symmetric to each other with respect to the center C4 of the nozzle board 35. Similarly, the first discharge liquid chamber 43*a* and the second discharge liquid chamber 43*b* are arranged to be point-symmetric to each other with respect to the center C4 of the nozzle board 35. The position of the inflow port 38 in the supply liquid chamber 40 and the position of the outflow port 44 in the discharge liquid chamber 43 are not limited to the illustrated configuration, and can be set in a predetermined position.

In the present embodiment, when the ink circulates, if the ink is introduced from the inflow port 38 to the supply liquid chamber 40, the ink in the supply liquid chamber 40 flows along the W direction as indicated by a hatching arrow and is supplied to the pressure chamber 25 through the first individual communication path 45. The ink, which has not been ejected from the nozzle 8, flows into the discharge liquid chamber 43 through the second individual communication path 47 as indicated by a black arrow. That is, the ink flows from the supply liquid chamber 40 into the discharge liquid chamber 43 through the pressure chamber 25. The ink, which has flowed into the discharge liquid chamber 43, is sent out from the outflow port 44 and returns to the liquid storage member 3. While the pump 6 is driven, the ink continuously circulates between the inflow port 38 and the outflow port 44. The other configurations are the same as those of the first embodiment illustrated in FIG. 8. Even in a configuration of the present embodiment, when bubbles are generated inside the head unit 10, the bubbles can be discharged to the outside of the head unit 10. As a result, the amount of the ink consumed for the maintenance operation can be reduced. Further, since the ink circulates through the individual flow path such as the pressure chamber 25, it is possible to suppress the thickening of the ink near the nozzles 8 and the sedimentation of the contained components in the ink. Accordingly, the number of times of maintenance operations can be further reduced. Even in the present embodiment, similar to the first modification example of the first embodiment, as the number of the head units 10 increases, the formation density of the nozzles 8 increases or two types of the ink can be ejected.

As described above, in the liquid ejecting head 2 and the liquid ejecting apparatus 1 including the same according to the present disclosure, since the head unit 10 is provided with the inflow port 38 and the outflow port 44, and the liquid can circulate therebetween, the number of times of so-called maintenance operations, such as a cleaning operation and a flushing operation, for forcibly discharging thickened ink and bubbles inside the head unit 10 from the nozzles, can be reduced, so that the amount of the liquid consumed for the maintenance operations can be reduced. As a result, ejection characteristics of the nozzle 8 (that is, characteristics such as the amount of ejected ink droplets and a flying speed of the ink droplets) can be favorably maintained even while consumption of the ink is reduced.

In the above-described embodiments, in a configuration in which the nozzle board 35 includes the nozzle row 7-1 and the nozzle row 7-2, a configuration in which the nozzle row 7-1 and the nozzle row 7-2 are arranged to be point-symmetric to each other with respect to the center C4 of the nozzle board 35 is illustrated. However, the present disclosure is not limited thereto. In short, when viewed from the +Z direction, among the nozzle row 7-1 and the nozzle row 7-2, the nozzle row 7-1 and the nozzle row 7-2 may be arranged to be point-symmetric to each other with respect to a central point of a virtual straight line connecting the nozzle 8 disposed at an end portion on the most +W direction side and the nozzle 8 disposed at an end portion on the most −W direction side, and the central point and the center C4 of the nozzle board 35 may not be necessarily coincide with each other. Further, in the fifth embodiment, a configuration can be employed in which the supply liquid chamber 40*a* and the supply liquid chamber 40*b* are arranged to be point-symmetric to each other with respect to the central point and the discharge liquid chamber 43*a* and the discharge liquid chamber 43*b* are arranged to be point-symmetric to each other with respect to the central point.

In addition, the present disclosure can be applied to a liquid ejecting head and a liquid ejecting apparatus including the same, the liquid ejecting head including a plurality of color material ejecting heads used for manufacturing a color filter, such as a liquid crystal display, a plurality of electrode material ejecting heads used for forming an electrode, such as an organic electro luminescence display (EL) and a surface emitting display (FED), a plurality of bioorganic material ejecting heads used for manufacturing a biochip (biochemical elements), or the like.

Hereinafter, the technical spirit and the effect, which are grasped in the above-described embodiments and modification examples, will be described.

According to an aspect of the present disclosure, there is provided a liquid ejecting head in which a plurality of head units for ejecting a liquid from nozzles onto a medium that is relatively moved in a first direction are arranged side by side in a second direction perpendicular to the first direction, in which the head unit includes: a nozzle row in which the plurality of nozzles are arranged side by side along a third direction intersecting the first direction and the second direction; a pressure chamber which communicates with the nozzles; a pressure generation element which causes a pressure change in the liquid inside the pressure chamber; a supply liquid chamber which communicates with a plurality of the pressure chambers and into which the liquid to be supplied to each pressure chamber is introduced; an inflow port through which the liquid flows into the head unit; and an outflow port through which the liquid flows out of the head unit (first configuration).

With this configuration, the inflow port and the outflow port are provided, and the liquid can circulate therebetween. Therefore, even when bubbles are generated in a flow path inside the head unit, the bubbles can be discharged. As a result, the number of times of so-called maintenance operations, such as a cleaning operation and a flushing operation, for forcibly discharging the liquid inside the head unit from the nozzles, can be reduced, and the amount of the liquid consumed for the maintenance operations can be reduced.

Further, in the first configuration, a configuration can be employed in which the inflow port and the outflow port are provided in the supply liquid chamber (second configuration).

With this configuration, since the inflow port and the outflow port are provided in the supply liquid chamber, a configuration can be employed in which the liquid circulates in a smaller space.

Further, in the first configuration, a configuration can be employed in which the head unit includes a discharge liquid chamber which communicate with the plurality of pressure chambers and into which the liquid flows from the supply liquid chamber via the pressure chambers, the inflow port is provided in the supply liquid chamber, and the outflow port is provided in the discharge liquid chamber (third configuration).

With this configuration, since the liquid circulates via a flow path, individually provided in each nozzle, such as the pressure chamber, the thickening of the liquid near the nozzle and the sedimentation of the contained components in the liquid can be suppressed. Accordingly, the number of times of maintenance operations can be further reduced.

In the second configuration, a configuration can be employed in which the nozzle row has a first nozzle row and a second nozzle row that are arranged in a fourth direction that is perpendicular to the third direction and are biased to be opposite to each other in the third direction, the supply liquid chamber includes a first supply liquid chamber that communicates with the plurality of pressure chambers corresponding to the first nozzle row and a second supply liquid chamber that communicates with the plurality of pressure chambers corresponding to the second nozzle row, the first supply liquid chamber includes a first portion that extends in parallel to the first nozzle row in the third direction and a second portion that is continuous with the first portion and extends beyond an and of the first nozzle row, the second supply liquid chamber includes a third portion that extends in parallel to the second nozzle row in the third direction and a fourth direction that is continuous with the third portion and extends beyond an end of the second nozzle row, the first supply liquid chamber and the second supply liquid chamber are provided with the inflow port and the outflow port, respectively, and the first nozzle row and the second nozzle row are arranged to be point-symmetric to each other and have an overlapping portion in an area where the nozzles are formed when viewed from the fourth direction (fourth configuration).

With this configuration, the first supply liquid chamber and the second supply liquid chamber are provided to correspond to the first nozzle row and the second nozzle row, the inflow port and the outflow port are provided in each of the supply liquid chambers, and the liquid can circulate in each supply liquid chamber. Thus, even when bubbles are generated in a flow path inside the head unit, the bubbles can be discharged. As a result, the number of times of so-called maintenance operations, such as a cleaning operation and a flushing operation, for forcibly discharging the liquid inside the head unit from the nozzles, can be reduced, and the amount of the liquid consumed for the maintenance operations can be reduced. Further, since the first nozzle row and the second nozzle row are arranged to be point-symmetric to each other, and have the overlapping portion in the area where the nozzles are formed when viewed in the fourth direction, an area in which the first nozzle row and the second nozzle row are arranged in the first direction can be shortened.

In the third configuration, a configuration can be employed in which the nozzle row has a first nozzle row and a second nozzle row which are arranged side by side in a fourth direction perpendicular to the third direction, the supply liquid chamber includes a first supply liquid chamber which communicates with the plurality of pressure chambers corresponding to the first nozzle row and a second supply liquid chamber which communicates with the plurality of pressure chambers corresponding to the second nozzle row, the discharge liquid chamber includes a first discharge liquid chamber which communicates with the plurality of pressure chambers corresponding to the first nozzle row and into which the liquid flows from the first supply liquid chamber through the pressure chamber and a second discharge liquid chamber which communicates with the plurality of pressure chambers corresponding to the second nozzle row and into which the liquid flows from the second supply liquid chamber through the pressure chamber, the inflow port is provided in each of the first supply liquid chamber and the second supply liquid chamber, the outflow port is provided in each of the first discharge liquid chamber and the second discharge liquid chamber, and the first nozzle row and the second nozzle row are arranged to be point-symmetric to each other and are spaced apart from each other in the third direction (fifth configuration).

With this configuration, the first supply liquid chamber and the second supply liquid chamber are provided to correspond to the first nozzle row and the second nozzle row, the inflow port and the outflow port are provided in each of the supply liquid chambers, and the liquid can circulate in each supply liquid chamber. Thus, even when bubbles are generated in a flow path inside the head unit, the bubbles can be discharged. As a result, the number of times of so-called maintenance operations, such as a cleaning operation and a flushing operation, for forcibly discharging the liquid inside the head unit from the nozzles, can be reduced, and the amount of the liquid consumed for the maintenance operations can be reduced. Further, since the liquid circulates via a flow path, individually provided in each nozzle, such as the pressure chamber, the thickening of the liquid near the nozzle and the sedimentation of the contained components in the liquid can be suppressed. Accordingly, the number of times of maintenance operations can be further reduced.

In the fourth configuration and the fifth configuration, a configuration may be employed in which the plurality of nozzles of the first nozzle row and the plurality of nozzles of the second nozzle row provided in the same head unit are continuously arranged at a constant interval in the second direction when viewed from the first direction (sixth configuration).

With this configuration, dots of landing droplets can be continuously formed at a constant pitch in the second direction on the medium using the first nozzle row and the second nozzle row of the head unit.

In any one of the fourth to sixth configurations, a configuration may be employed in which the head unit includes a wiring member electrically coupled to the piezoelectric element, the liquid ejecting head includes a common wiring board electrically coupled to a plurality of the wiring members, and the odd-numbered wiring members of the head unit counted from one end in the second direction and the even-numbered wiring members of the head unit counted from the one end in the second direction are arranged to be point-symmetric to each other with respect to the third direction.

With this configuration, in the common wiring board, a space where wirings are arranged outside the wiring members located at both ends in the second direction becomes unnecessary. Accordingly, the common wiring board can be downsized, and as a result, the liquid ejecting head can be downsized. Accordingly, when the plurality of liquid ejecting heads are arranged side by side in the second direction, the liquid ejecting heads can be brought closer to each other, and the nozzles of the head units included in the liquid ejecting head can be arranged side by side at a constant pitch in the second direction.

The liquid ejecting apparatus according to the present disclosure includes the liquid ejecting head having any one of the first to seventh configurations, and a transport mechanism that transports a medium in the first direction.

According to the present disclosure, even while consumption of the liquid is reduced, ejection characteristics of each nozzle can be favorably maintained.

What is claimed is:

1. A liquid ejecting head comprising a plurality of head units that eject a liquid from nozzles onto a medium relatively moved in a first direction, and that are arranged side by side in a second direction perpendicular to the first direction, wherein each of the plurality of head units includes a first nozzle row in which first nozzles are arranged in a third direction intersecting the first direction and the second direction, a second nozzle row in which second nozzles are arranged in the third direction, first pressure chambers communicating with the first nozzles, second pressure chambers communicating with the second nozzles, pressure generation elements respectively corresponding to the first and second pressure chambers, a wiring member coupled to the pressure generation elements and protruding from the pressure generation elements at a non-right angle, a first supply liquid chamber that communicates with the first pressure chambers and that the liquid to be supplied to each of the first pressure chambers is introduced, a first discharge liquid chamber that communicates with the first pressure chambers and that the liquid flows from the first supply liquid chamber via the first pressure chambers, a second supply liquid chamber that communicates with the second pressure chambers and that the liquid to be supplied to each of the second pressure chambers is introduced, a second discharge liquid chamber that communicates with the second pressure chambers and that the liquid flows from the second supply liquid chamber via the second pressure chambers, a first inflow port through which the liquid flows into the head unit, and a first outflow port through which the liquid flows out of the head unit, a second inflow port through which the liquid flows into the second supply liquid chamber, and a second outflow port through which the liquid flows out of the second discharge liquid chamber, wherein:

the first nozzle row and the second nozzle row do not overlap when viewed in the third direction and a fourth direction perpendicular to the third direction, the first nozzle row and the second nozzle row are arranged to be point-symmetric to each other and are spaced apart from each other in the third direction, the first nozzle row is located between the first supply liquid chamber and the first discharge liquid chamber in the fourth direction, the second nozzle row is located between the second supply liquid chamber and the second discharge liquid chamber in the fourth direction, the first supply liquid chamber and the first discharge liquid chamber overlap when viewed in the fourth direction, the second supply liquid chamber and the second discharge liquid chamber overlap when viewed in the fourth direction, the first supply liquid chamber and the second discharge liquid chamber overlap when viewed in the third direction, the second supply liquid chamber and the first discharge liquid chamber overlap when viewed in the third direction, the first nozzles and the second nozzles provided in each of the plurality of head units are continuously arranged at a constant interval in the second direction when viewed in the first direction, and the wiring member of an odd-numbered head unit in the plurality of head units counted from one end in the second direction and the wiring member of an even-numbered head unit in the plurality of head units counted from the one end in the second direction are arranged to be point-symmetric to each other in the third direction.

2. The liquid ejecting head according to claim 1, wherein the liquid ejecting head includes a common wiring board coupled to the wiring members.

3. A liquid ejecting apparatus comprising:

the liquid ejecting head according to claim 1; and a transport mechanism transporting a medium in the first direction.

4. The liquid ejecting head according to claim 1, wherein when viewed in an ejecting direction that the first nozzle ejects the liquid, a direction that the liquid flows from the first supply liquid chamber to the first discharge liquid chamber is opposite to a direction that the liquid flows from the second supply liquid chamber to the second discharge liquid chamber.

* * * * *